US006167225A

United States Patent [19]

Sasaki et al.

[11] Patent Number: 6,167,225

[45] Date of Patent: Dec. 26, 2000

[54] LIQUID DEVELOPING METHOD OF ELECTROSTATIC LATENT IMAGE AND LIQUID DEVELOPING APPARATUS

[75] Inventors: Tsutomu Sasaki, Chiba; Masahiko Itaya, Akishima, both of Japan

[73] Assignee: Research Laboratories of Australia Pty Ltd, South Australia, Australia

[21] Appl. No.: 08/677,530

[22] Filed: Jul. 10, 1996

Related U.S. Application Data

[63] Continuation-in-part of application No. PCT/JP95/00012, Jan. 10, 1995.

[30] Foreign Application Priority Data

Jan. 10, 1994 [JP] Japan ..... 6-013167

[51] Int. Cl.[7] ..... G03G 15/10; G03G 9/08

[52] U.S. Cl. ..... 399/237; 399/239; 430/117

[58] Field of Search ..... 399/225, 227, 399/233, 237, 239, 243, 240, 238; 430/117, 100; 118/651, 659, 660, 661

[56] References Cited

U.S. PATENT DOCUMENTS

| | | | |
|---|---|---|---|
| 4,311,780 | 1/1982 | Mochizuki et al. | 430/125 |
| 4,522,908 | 6/1985 | de Winter et al. | 430/115 |
| 4,564,574 | 1/1986 | Uytterhoeven et al. | 430/115 |
| 4,761,357 | 8/1988 | Tavernier et al. | 399/239 |
| 4,827,305 | 5/1989 | Enoguchi et al. | 399/246 |
| 4,905,047 | 2/1990 | Ariyama | 399/102 |
| 4,967,231 | 10/1990 | Hosoya et al. | 399/285 |

FOREIGN PATENT DOCUMENTS

| | | | |
|---|---|---|---|
| 53-53332 | 5/1978 | Japan . | |
| 53-57039 | 5/1978 | Japan . | |
| 53-117424 | 10/1978 | Japan . | |
| 53-117425 | 10/1978 | Japan . | |
| 53-117426 | 10/1978 | Japan . | |
| 55-120058 | 9/1980 | Japan . | |
| 1-250976 | 10/1989 | Japan . | |
| 3-31882 | 2/1991 | Japan . | |
| 3-75767 | 3/1991 | Japan . | |
| 3-41733 | 4/1991 | Japan . | |
| 4-298762 | 10/1992 | Japan . | |
| 5-80650 | 4/1993 | Japan . | |
| 7-152257 | 6/1995 | Japan | 399/237 |
| 7-334003 | 12/1995 | Japan | 399/237 |
| WO 93/01531 | 1/1993 | WIPO . | |

OTHER PUBLICATIONS

Patent Abstracts of Japan, vol. 004, No. 107 (P–021), Jul. 31, 1980 & JP 55 065964A (Ricoh Co Ltd), May 17, 1980—Abstract.

Patent Abstracts of Japan, vol. 011, No. 383 (P–646), Dec. 15, 1987 & JP 62 150261A (Fuji Photo Film Co Ltd), Jul. 4, 1987—Abstract.

Patent Abstracts of Japan, vol. 009, No. 195 (P–379), Aug. 13, 1985 & JP 60 060678A (Canon KK), Apr. 8, 1985—Abstract.

Patent Abstracts of Japan, vol. 004, No. 160 (P–035), Nov. 8, 1980 & JP 55 106480A (Canon Inc), Aug. 15, 1980—Abstract.

*Primary Examiner*—D. Rutledge

*Attorney, Agent, or Firm*—Evenson, McKeown, Edwards & Lenahan P.L.L.C.

[57] ABSTRACT

This invention relates to an electrostatic latent image liquid developing method and liquid developing apparatus that can prevent adhesion of toner to the non-image parts on the image bearing member and thereby prevent the occurrence of image inaccuracies. The method provides a pre-wetting process that applies pre-wet liquid to photosensitive member 10 and a developing process. In the developing process, a thin layer of a highly viscous liquid developing agent, in which toner is dispersed at a high concentration in a non-conductive liquid, is formed on the elastic developing roller 506. Developing roller 506 is rotated and, at the same time, the liquid developing agent layer on developing roller 506 is brought into contact with the pre-wet liquid layer on photosensitive member 10 in order to supply liquid developing agent to the latent image on photosensitive member 10. Thus, the toner develops the electrostatic latent image formed on photosensitive member 10.

36 Claims, 13 Drawing Sheets

LIQUID DEVELOPING METHOD OF ELECTROSTATIC LATENT IMAGE AND LIQUID DEVELOPING APPARATUS

CROSS-REFERENCE TO RELATED APPLICATIONS

This application is a continuation-in-part under 35 USC § 120 and § 365 of PCT application serial no. PCT/JP95/00012, filed Jan. 10, 1995.

FIELD OF THE INVENTION

This invention relates to a liquid developing method and a liquid developing apparatus that use a liquid developing agent to make visible images from electrostatic latent images formed by electrophotography, electrostatic recording, ionography, or other methods.

BACKGROUND OF THE INVENTION

In the liquid developing apparatus of related art, electrostatic latent images formed on the image bearing member are made into visible images by toner, which consists of charged developing particles. Various methods are used to supply the liquid developing agent to the surface of latent images on the image bearing member. For example, a developing roller may be used as the developing agent bearing member, wherein the surface of the roller has depressions and protrusions such that the liquid developing agent is held in the depressions and supplied to the image bearing member. Alternatively, a sponge roller is used as the developing agent bearing member. The sponge roller is pressed against the image bearing member such that the liquid developing agent that has been absorbed by the sponge roller is supplied to the image bearing member. In another method, the image bearing member is immersed in the developing agent tank in which the liquid developing agent is stored such that the liquid developing agent is supplied directly to the image bearing member without use of a developing agent bearing member.

The low-viscosity liquid developing agent usually used in the electrostatic recording and similar apparatus in the related art consists of IsoparG (registered trademark of the Exxon Corporation), an organic solvent, in which toner is mixed at a proportion of about 1 to 2%. It is desirable to use a more highly concentrated liquid developing agent than that used in the apparatus of the related art and to reduce the volatility of the solvent to allow production of a safer and smaller liquid developing apparatus, but this type of apparatus cannot be found in the related art. Moreover, the ideal method of supplying liquid developing agent to the latent image surface on the image bearing member when using a highly concentrated and highly viscous liquid developing agent (a liquid developing agent with a high viscosity of 100 to 10,000 mPa.s in which toner is dispersed at high concentrations in the non-conductive liquid) which adheres more strongly to the image bearing member was heretofore unknown.

DISCLOSURE OF THE INVENTION

The aim of this invention is to provide a liquid developing method and liquid developing apparatus that use a highly concentrated and highly viscous liquid developing agent for developing electrostatic latent images and that prevent adhesion of toner to the non-image parts on the image bearing member and thereby prevent image inaccuracies.

The electrostatic latent image liquid developing method of this invention uses charged developing particles (toner) to develop electrostatic latent images that are formed on the image bearing member and comprises a developing process wherein a thin layer of highly viscous liquid developing agent, in which the toner is dispersed in the non-conductive liquid at a high concentration, is formed on the elastic cylindrical developing agent bearing member and the developing agent bearing member is rotated in the driven direction in relation to the image bearing member and, at the same time, the layer of liquid developing agent on the developing agent bearing member is brought into contact with the image bearing member and thereby supplies liquid developing agent to the surface of the latent image on the image bearing member. The preferred viscosity of the liquid developing agent is from 100 to 10,000 mPa.s, and the preferred thickness of the layer of liquid developing agent on the developing agent bearing member is from 5 to 40 $\mu$m. The desirable degree of hardness for the developing agent bearing member is from 5 to 60 degrees JIS-A.

It is desirable that rollers be provided at both ends of the developing agent bearing member and that the external diameter of the rollers be slightly smaller than the external diameter of the developing agent bearing member such that the rollers contact the image bearing member and thereby regulate the contact force of the developing agent bearing member against the image bearing member.

It is desirable that the surface, at least, of the developing agent bearing member be formed from a conductive material that does not absorb the above-mentioned liquid developing agent.

The inside of the developing agent bearing member may be a foam-type material.

In addition, it is desirable that the electrostatic latent image liquid developing method of this invention also provides a pre-wetting process, wherein a chemically inactive dielectric pre-wet liquid that has good release properties is applied to the image bearing member, before the developing process.

In the electrostatic latent image liquid developing method of this invention, the elastic cylindrical developing agent bearing member is rotated in the driven direction in relation to the image bearing member and, at the same time, the layer of liquid developing agent on the developing agent bearing member is brought into contact with the image bearing member and thereby produces elastic deformation of the developing agent bearing member in the developing area. This allows the contact force to be distributed when the liquid developing agent layer on the developing agent bearing member touches the image bearing member. Thus, this method prevents excessive squashing of the liquid developing agent layer in the developing area on the developing agent bearing member, thereby preventing adhesion of the toner to the non-image parts on the image bearing member and preventing image inaccuracies. Moreover, since the toner is dispersed at a high concentration and only a thin layer of liquid is used for the developing process, the volume of liquid can be much lower than for the low-concentration liquid developing agent used in the prior art. Note that, if the viscosity of the liquid developing agent exceeds 10,000 mPa.s, it is difficult to stir the toner into the non-conductive liquid and manufacture of the liquid developing agent becomes difficult. Therefore, liquid developing agents with viscosities over 10,000 mPa.s are impractical for cost reasons. If the viscosity of the liquid developing agent is lower than 100 mPa.s, the toner concentration is low and disperses poorly. Therefore, a thin layer of developing liquid cannot be used for the developing process. The layer of liquid developing agent can be thin when the toner concentration is high, but a thick layer is required when the concentration is low. Moreover, the layer must be thin when the viscosity is high. If the layer is more than 40 μm, the toner adheres excessively, producing image noise. If the layer is less than 5 μm, the solid parts of images do not print evenly. A developing agent bearing member with a hardness of less than 5 degrees JIS-A is too soft and does not easily hold a fixed shape. A developing agent bearing member with a hardness of more than 60 degrees JIS-A is too hard, making it necessary to mount the developing agent bearing member such that a minute gap is formed between the developing agent bearing member and the image bearing member when the layer of liquid developing agent on the developing agent bearing member is brought into contact with the image bearing member so that the layer of liquid developing agent is not squeezed excessively. This requirement complicates mounting of the developing agent bearing member.

Rollers that have an external diameter which is slightly smaller than the external diameter of the developing agent bearing member may be provided at both ends of the developing agent bearing member such that the rollers contact the image bearing member and thereby regulates the contact force of the developing agent bearing member against the image bearing member. If so, the contact pressure when the layer of liquid developing agent on the developing agent bearing member touches the image bearing member can be controlled easily.

In addition, the surface, at least, of the developing agent bearing member may be formed from a conductive material that does not absorb the liquid developing agent. If so, the developing agent bearing member does not absorb or release the liquid developing agent when the contact between the layer of liquid developing agent on the developing agent bearing member and the image bearing member causes elastic deformation of the developing agent bearing member. This prevents disturbance of the liquid developing agent layer.

Use of a foam-type material inside the developing agent bearing member makes it comparatively easy to obtain a developing agent bearing member that has the desired hardness value.

In addition, a pre-wetting process that applies a pre-wet liquid, being a chemically inactive dielectric liquid with good release properties, may be provided before the developing process. If so, the use of an elastic developing agent bearing member in this invention allows a two-layer structure to be maintained for the liquid developing agent layer on the developing agent bearing member in the developing area and the pre-wet liquid layer on the image bearing member while the two layers are touching. As a result, the adhesion of toner to the non-image parts on the image bearing member and the occurrence of image inaccuracies can be more effectively prevented because the liquid developing agent layer touches the surface of the image bearing member through the medium of the pre-wet liquid layer.

A pre-wet liquid with good release properties and good insulating properties can be obtained by using a liquid wherein the viscosity is from 0.5 to 5 mPa.s, the electric resistance is $10^{12}$ Ωcm or more, the boiling point is from 100 to 250° C., and the surface tension is 21 dyne/cm or less. Since the pre-wet liquid is absorbed by the paper or other medium during the transfer process, the liquid must be vaporised during fusing. Accordingly, a viscosity of from 0.5 to 5 mPa.s is desirable because this vaporises easily. If the viscosity is higher than 5 mPa.s, the liquid does not vaporise easily. If the viscosity is less than 0.5 mPa.s, the liquid becomes highly volatile and legal restrictions related to dangerous substances apply, making the liquid unsuitable. If the boiling point of the pre-wet liquid is less than 100° C., higher quantities of vapour occur. This causes problems related to storage methods for the pre-wet liquid, necessitates a tightly sealed structure for the apparatus as a whole, and makes it difficult to improve the work environment. If the boiling point is higher than 250° C., the paper curls during fixing and, therefore, the pre-wet liquid cannot be used. In addition, large amounts of energy are required for heating, which increases costs. If the electric resistance is lower than $10^{12}$ Ωcm, the insulating property deteriorates and the liquid cannot be used as a pre-wet liquid. Therefore, it is desirable that the electric resistance value be as high as possible. If the surface tension is higher than 21 dyne/cm, the wettability deteriorates and the intimacy of the contact with the liquid developing agent deteriorates. Accordingly, it is desirable that the surface tension value be as low as possible.

A highly viscous liquid developing agent for the electrostatic latent image liquid developing method of this invention can be obtained by use of a liquid developing agent in which the viscosity of the non-conductive liquid is from 0.5 to 1,000 mPa.s, the electric resistance is $10^{12}$ Ωcm or more, the surface tension is 21 dyne/cm or less, and the boiling point is 100° C. or more. Since the layer of liquid developing agent formed on the surface of the developing agent bearing member is thin, the liquid developing agent can contain only an extremely small amount of non-conductive liquid. This means that the amount of non-conductive liquid contained in the liquid developing agent that is supplied to the surface of the latent image on the image bearing member is also extremely small. Since only very small amounts of non-conductive liquid are absorbed by the paper or other medium during the transfer process, the problems that can be caused by the adherence of the non-conductive liquid to the paper or other medium when the viscosity is 1,000 mPa.s or less do not arise. However, the liquid becomes more highly volatile if the viscosity is lower than 0.5 mPa.s. Therefore, special handling as a dangerous substance is required, making the liquid unsuitable at these viscosities. If the boiling point of the non-conductive liquid is lower than 100° C., higher quantities of vapour occur. This causes problems related to storage methods for the developing agent, necessitates a tightly sealed structure for the apparatus as a whole, and makes it difficult to improve the work environment. If the electric resistance is lower than $10^{12}$ Ωcm, the insulating property deteriorates. This causes toner conductivity problems which prevent use of the liquid as a developing agent. Therefore, it is desirable that the electric resistance value be as high as possible. If the surface tension is higher than 21 dyne/cm, the wettability deteriorates and the intimacy of the contact with the pre-wet liquid deteriorates. Accordingly, it is desirable that the surface tension value be as low as possible.

A liquid developing agent in which the toner is dispersed at a high concentration in the non-conductive liquid can be obtained by using toner with an average particle diameter of 0.1 to 5 μm at concentrations of 5 to 40%. The resolution improves in roughly inverse proportion to the size of the toner particle diameter. Normally, the toner on the printed paper exists as aggregates of 5 to 10 layers. Thus, resolution deteriorates if the average particle diameter of the toner is over 5 μm. If the average particle diameter of the toner is less than 0.1 μm, the physical adhesive strength is high and the toner does not release easily during transfer.

DESCRIPTION OF THE PREFERRED EMBODIMENTS

The first embodiment of this invention is explained below with reference to the drawings.

Figure 1:
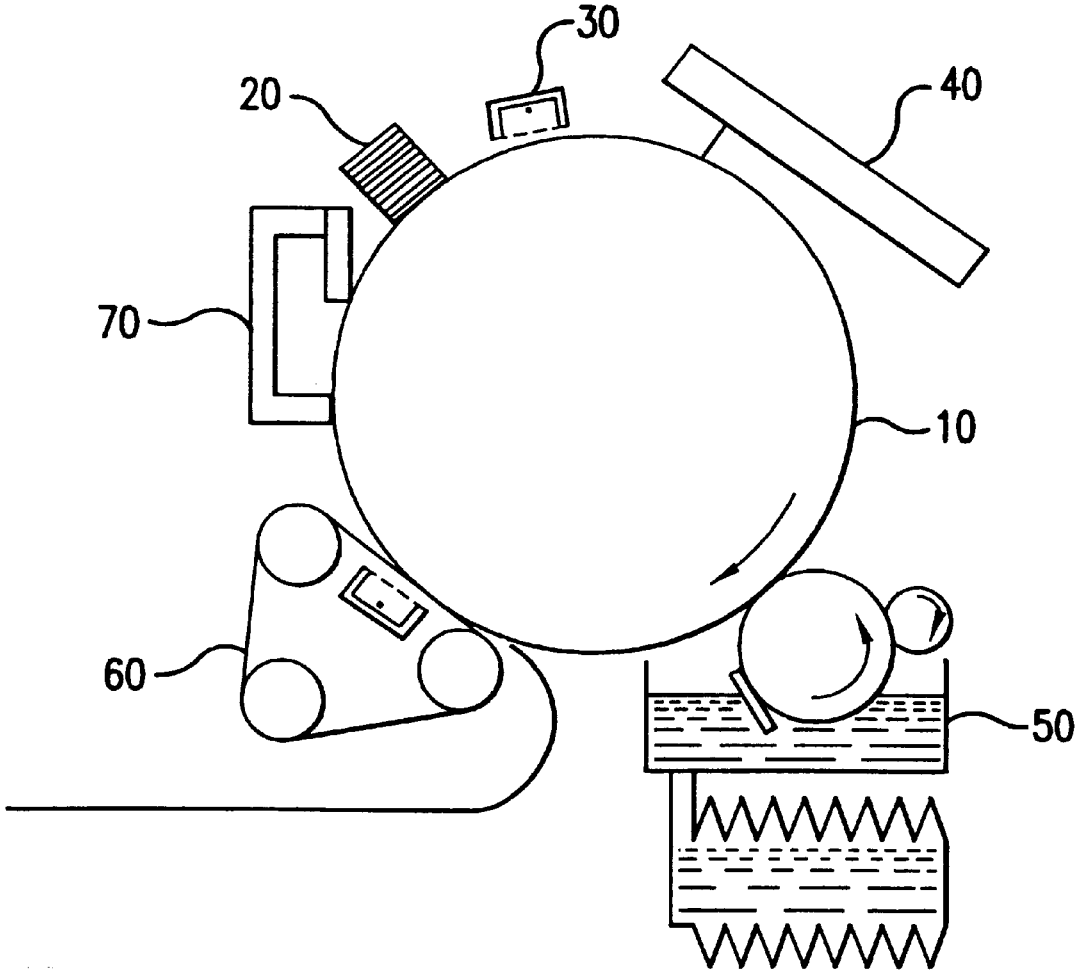
FIG. 1 is an overview of the structure of the electrostatic latent image liquid developing apparatus in the first embodiment of this invention.
Figure 2:
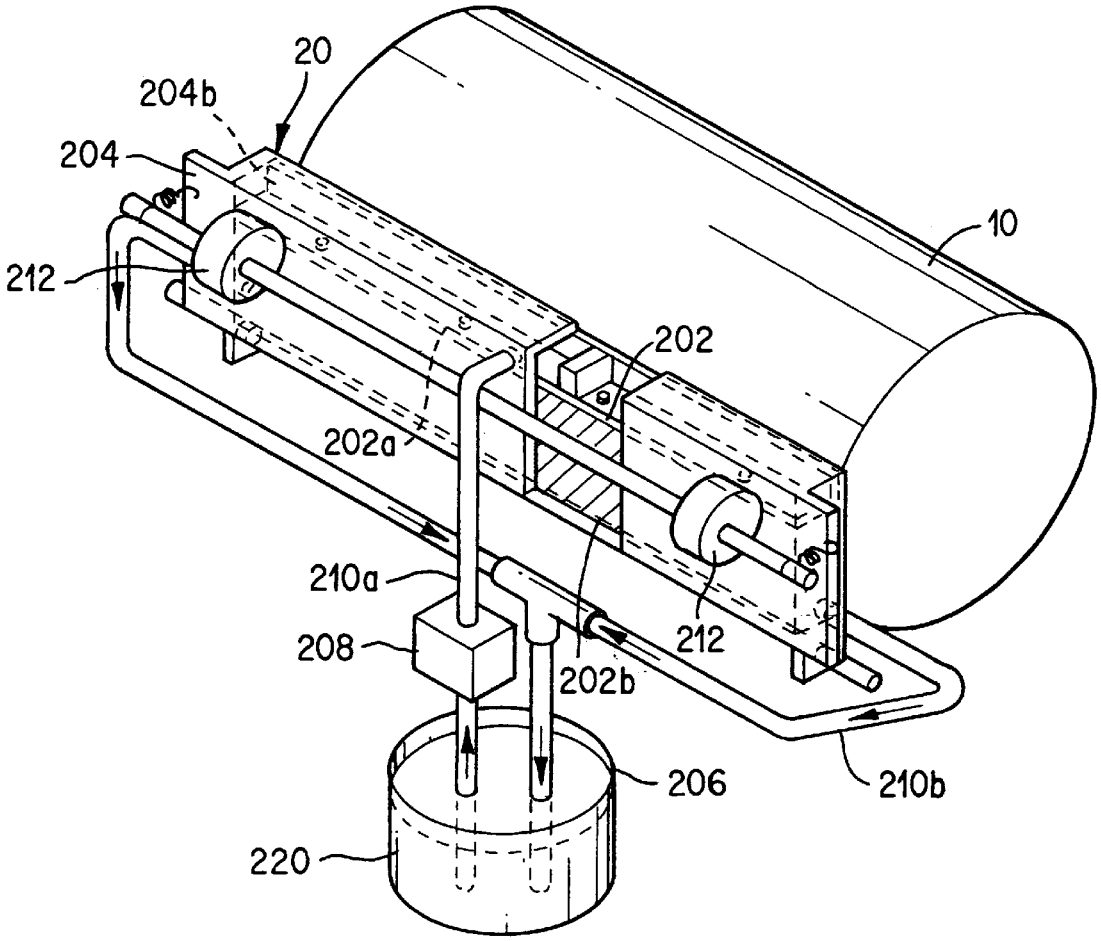
FIG. 2 is an oblique view outlining pre-wet apparatus that can be used by the electrostatic latent image liquid developing apparatus shown in FIG. 1.
Figure 4A:
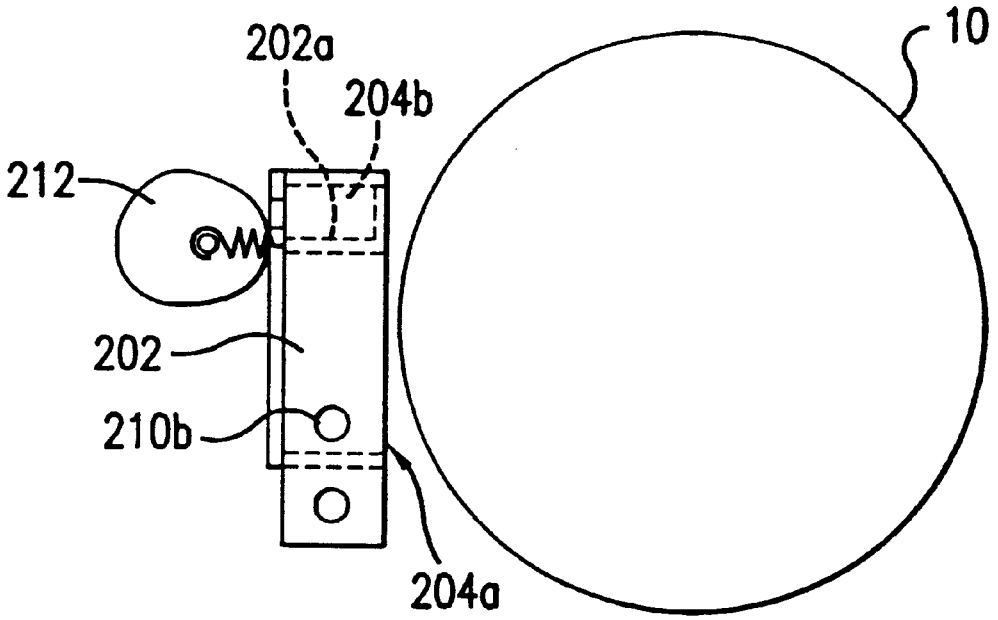
FIGS. 4(A)–4(B) show the operation of the pre-wet liquid apparatus shown in FIG. 2.
Figure 4B:
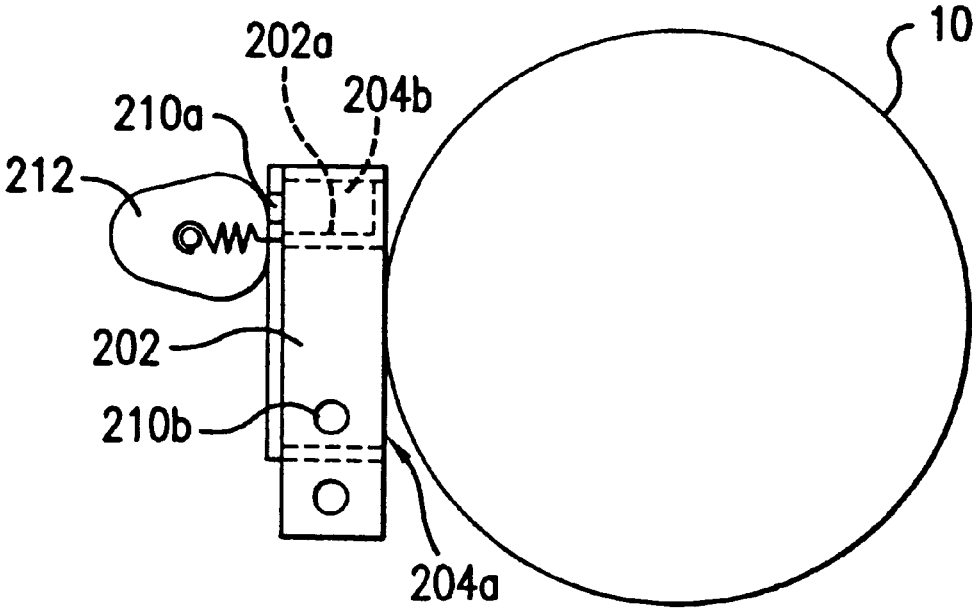
Figure 5:
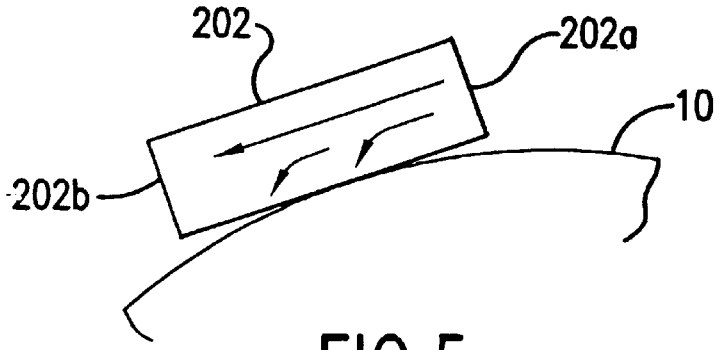
FIG. 5 explains the flow of the pre-wet liquid when the pre-wet liquid supply element is in contact with the photosensitive member.
Figure 15:
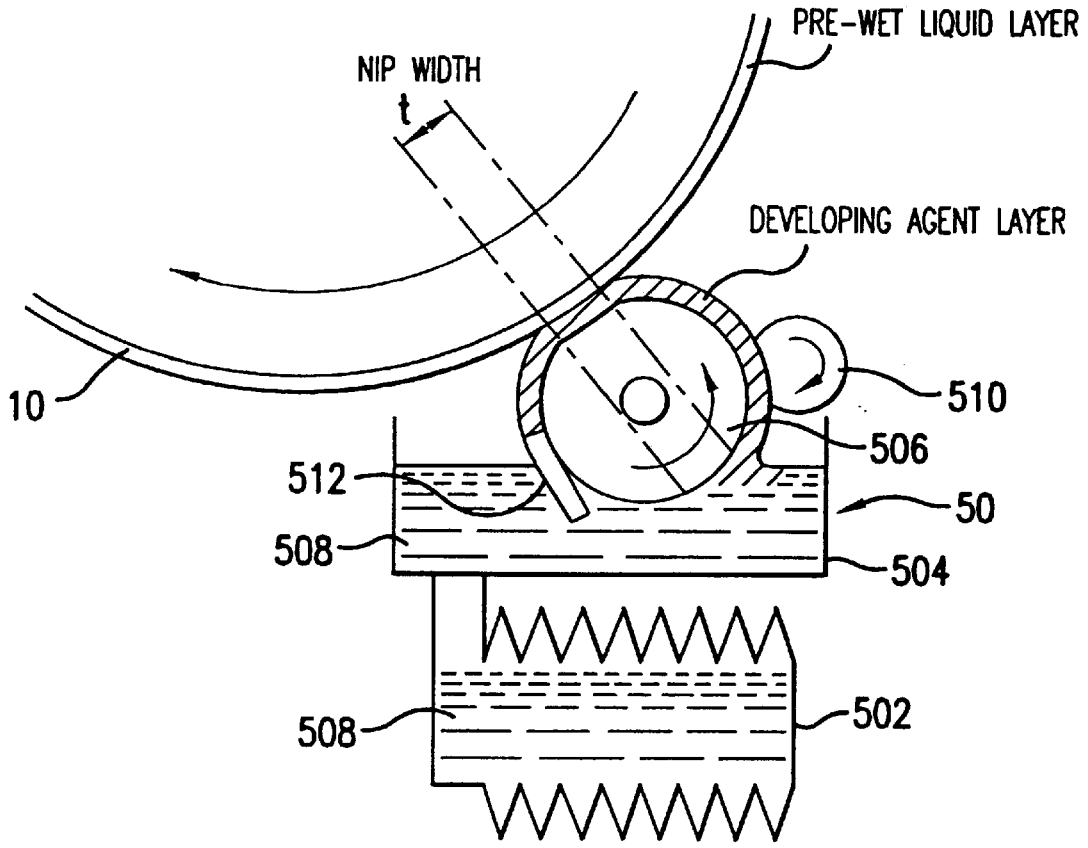
FIG. 15 shows an overview of developing apparatus that can be used by the electrostatic latent image liquid developing apparatus shown in FIG. 1.
Figure 16:
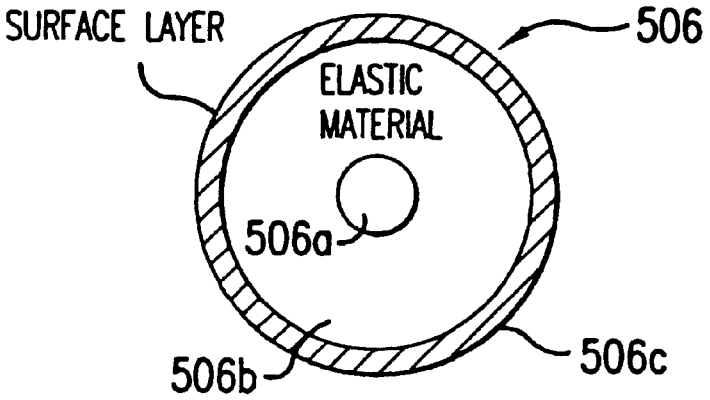
FIG. 16 shows an overview of the developing roller used by the developing apparatus shown in FIG. 15.
Figure 17A:
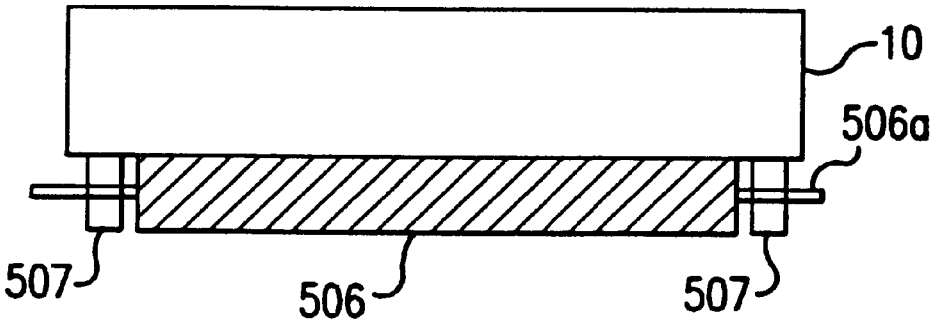
FIGS. 17(A)–17(B) show the method of making contact between the photosensitive member and the developing roller.
Figure 17B:
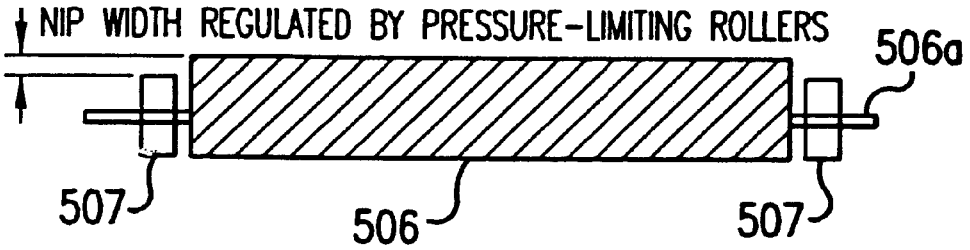

FIG. 1 is an overview of the structure of the electrostatic latent image liquid developing apparatus in the first embodiment of this invention, FIG. 2 is an oblique view outlining pre-wet apparatus that can be used by the electrostatic latent image liquid developing apparatus shown in FIG. 1, FIG. 3 explains the operation of the electrostatic latent image liquid developing apparatus shown in FIG. 1, FIG. 4 explains the operation of the pre-wet liquid apparatus shown in FIG. 2, FIG. 5 shows the flow of the pre-wet liquid when the pre-wet liquid supply element is in contact with the photosensitive member, FIG. 15 shows an overview of developing apparatus that can be used by the electrostatic latent image liquid developing apparatus shown in FIG. 1, FIG. 16 shows an overview of the developing roller used by the developing apparatus shown in FIG. 15, and FIG. 17 explains the method of making contact between the photosensitive member and the developing roller.

The electrostatic latent image liquid developing apparatus that is the first embodiment, shown in FIG. 1, is provided with photosensitive member 10, which is the image bearing member, pre-wet apparatus 20 that applies pre-wet liquid to photosensitive member 10, charging apparatus 30 that gives an electric charge to photosensitive member 10, exposure apparatus 40 that exposes the image on photosensitive member 10, developing apparatus 50 that makes a visible image from an electrostatic latent image by means of supplying toner to the parts on photosensitive member 10 where the electrostatic latent image is formed, transfer apparatus 60 that transfers the toner on photosensitive member 10 to the prescribed paper, and cleaning apparatus 70 that removes toner that has adhered to photosensitive member 10.

The related technology used for the electrophotographic type of printers in related art can, in most cases, be used for charging apparatus 30, exposure apparatus 40, transfer apparatus 60, and cleaning apparatus 70. Therefore, the explanation of this embodiment omits explanations for the above types of apparatus, but explains the main parts of this invention, that is, pre-wet apparatus 20 and developing apparatus 50.

Pre-wet apparatus 20 in this embodiment, shown in FIG. 2, is provided with plate-shaped pre-wet liquid supply element 202 that is approximately as long as the width of the image created on photosensitive member 10, casing 204 that houses pre-wet liquid supply element 202, tank 206 that stores pre-wet liquid 220, pump 208 that draws up pre-wet liquid 220 that is stored in tank 206, tubes 210*a* and 210*b*, and position changing apparatus 212.

A continuously porous material that has a three-dimensional mesh structure in which the pores are continuous, such as Bell-eta (registered trademark of Kanebo, Ltd.) can be used as pre-wet liquid supply element 202. The amount of pre-wet liquid 220 that can be retained by Bell-eta is limited to the capacity of the pores. When the supply of pre-wet liquid 220 exceeds the capacity of the pores, prewet liquid 220 can be released uniformly in a perpendicular direction in relation to the direction of flow of pre-wet liquid 220. The side of casing 204 that faces photosensitive member 10 is provided with aperture 204*a* that allows the lower side of pre-wet liquid supply element 202 to contact photosensitive member 10, as shown in FIG. 4. Tube 210*a* carries the pre-wet liquid 220 that is drawn up by pump 208 to supply side 202*a* of pre-wet liquid supply element 202. Note that empty space 204*b* is formed between casing 204 and supply side 202*a* of pre-wet liquid supply element 202. Pre-wet liquid 220 accumulates in empty space 204*b* before being supplied from supply side 202*a*. Tube 210*b* carries the pre-wet liquid 220 that is released from release side 202*b* of pre-wet liquid element 202 to tank 206. When an external signal is not input, position changing apparatus 212 holds pre-wet liquid supply element 202 in the separated position from photosensitive member 10, as shown in FIG. 4(A). When an external signal is input, pre-wet liquid supply element 202 contacts photosensitive member 10, as shown in FIG. 4(B).

Developing apparatus 50 of the first embodiment, shown in FIG. 15, is provided with bellows pump 502 that both stores and discharges the highly concentrated and highly viscous liquid developing agent 508 (described later), trap 504 that holds the liquid developing agent 508 that is released by bellows pump 502, developing roller 506, which is the developing agent bearing member, disposed such that the lower part of the roller is immersed in the liquid developing agent 508 that is stored in trap 504, regulatory roller 510 that is formed from an elastic material and that regulate the thickness of the film of liquid developing agent 508, and scraper blade 512 that scrapes off the liquid developing agent 508 that is adhering to developing roller 506.

Developing roller 506 is approximately as long as the width of the image created on photosensitive member 10 and, as shown in FIG. 16, comprises a core bar 506*a* formed as a rigid body of stainless steel or similar, an elastic cylindrical element 506*b* formed around the periphery of core bar 506*a*, and surface layer 506*c* formed on the surface of cylindrical element 506*b*. The elastic material used to form cylindrical element 506*b* may be a foam-type material such as polystyrene, polyethylene, polyurethane, polyvinyl chloride, or NBR (acrylonitrile butadiene rubber), or a rubber material with a low degree of hardness such as silicone rubber or urethane rubber. However, if rubber materials are usually used in their elastic deformed state over a period of years, the change in shape may become permanent such that the material does not return to the original cylindrical shape. Therefore, if possible, use of a foam-type material is preferred as the elastic material that forms cylindrical element 506*b*. Surface layer 506*c* is formed from a conductive material that is not caused to swell by the silicone oil that is the carrier liquid in liquid developing agent 508 (described later). Note that an electric resistance value of about $10^3$ Ωcm is desirable for the conductive material of developing roller 506 to allow an electrical developing bias to be applied. Various methods of forming surface layer 506*c* on the surface of cylindrical element 506*b* can be used. For example, a coating of a synthetic rubber compound in which conductive particles, such as carbon black, are dispersed can be formed on the surface of cylindrical element 506*b*. Or, cylindrical element 506*b* may be covered with a heat-shrink tube and heat may be applied to shrink the tube. Alternatively, an elastic material may be poured into a conductive tube and the foam formation process for the elastic material may take place inside the tube such that cylindrical element 506*b* is formed inside surface layer 506*c*. A resin tube, such as a polyimide, polycarbonate, or nylon may be used as the conductive tube, or a nickel or other type of metal tube may be used. A resin tube, such as perfluoroalkoxy resin (PFA) or polytetrafluoroethylene (PTFE) may be used as a conductive heat-shrink tube. For the above tubes, endless tubes without joins are preferred. Note that surface layer 506*c* need not be formed on the surface of cylindrical element 506*b* if cylindrical element 506*b* is formed from an elastic material such as urethane rubber that is not made to swell by silicone oil. However, it is necessary that developing roller 506 be given the required electric resistance value, that is, about $10^3$ Ωcm, such that an electrical developing bias can be applied. This value can be obtained by performing a conductive process on the surface of cylindrical element 506*b* or by adding minute conductive particles to the elastic material from which cylindrical element 506*b* is formed.

Developing roller 506 is positioned such that it contacts photosensitive member 10, as shown in FIG. 15, and rotates in the opposite direction to the direction of rotation of photosensitive member 10, that is, in the driven direction in relation to photosensitive member 10. This rotation draws up the liquid developing agent 508 stored in trap 504 and carries it to the surface of photosensitive member 10. The elastic deformation caused by the pushing force of developing roller 506 against photosensitive member 10 forms nip width t, as shown in FIG. 15. Note that the preferred degree of hardness for developing roller 506 is from 5 to 60 degrees JIS-A. If the hardness is less than 5 degrees JIS-A, the roller is too soft and does not easily hold the required shape. If the hardness is greater than 60 degrees JIS-A, the roller is too hard and it becomes necessary to mount developing roller 506 in such a way that a minute gap is accurately formed between developing roller 506 and photosensitive member 10. This is necessary in order to maintain the two-layer state of the liquid developing agent layer on developing roller 506 and the pre-wet liquid layer on photosensitive member 10 when the two layers touch, but complicates the mounting of developing roller 506. The nip width t formed by elastic deformation of developing roller 506 is set in accordance with the relationship with the developing time constant determined from the electrical circuit, including the capacity formed by the developing roller, developing agent layer, and photosensitive member and the resistance component. Note that the pushing force of developing roller 506 against photosensitive member 10 can be regulated, as shown in Drawings 17(A) and 17(B), by arranging pressure-limiting rollers 507 that contact photosensitive member 10 at both ends of developing roller 506*b*. The pushing force can then be adjusted by exchanging pressure-limiting rollers 507 for rollers with different external diameters. Pressure-limiting rollers 507 are selected such that the external diameter is smaller than that of developing roller 506 but larger than the compressed limit of the developing roller.

Regulatory roller 510 is disposed such that it contacts developing roller 506 and rotates in the opposite direction to the direction of rotation of developing roller 506, thereby regulating the thickness of the layer of liquid developing agent 508 on developing roller 506 and forming a thin layer of liquid developing agent on developing roller 506. Experiments performed by the inventors showed that good results can be obtained if regulatory roller 510 rotates about twice as fast as the rotation speed of developing roller 506.

The image formation raw materials used in the first embodiment are explained next. The liquid developing agent 508 used in the first embodiment is comprised of toner and a carrier liquid. The toner is comprised of an epoxy or similar resin as a binder, an electric charge control agent that gives a specific charge to the toner, colour pigment, a dispersing agent that disperses the toner evenly, and so on. The composition of the toner is basically the same as the toner used in the liquid developing agents in the related art, but the formulae for the regulation of the electric charge characteristics and dispersion have been changed to suit silicone oil. If the average particle diameter of the toner is reduced, the resolution improves but the physical adhesive force also increases. This makes the toner difficult to release during transfer. Therefore, the average particle diameter of the toner used in the first embodiment is regulated such that most particles are about 2 to 4 μm in order to improve ease of transfer.

The viscosity of the liquid developing agent is determined by the types and concentrations of the carrier liquid, resin, colour pigment, electric charge control agent, and other components that are used. For the first embodiment, various viscosities in the range from 50 to 6,000 mPa.s and various toner concentrations in the range from 5 to 40% were tested.

A liquid with high electric resistance and low viscosity, such as dimethyl polysiloxane oil or a cyclic polydimethylsiloxane oil, is used as the carrier liquid. Note that, since the layer of liquid developing agent formed on the developing agent bearing member is formed as a thin film, the carrier liquid contained in the layer of liquid developing agent is only an extremely small amount. Therefore, the amount of carrier liquid included in the layer of liquid developing agent supplied to the surface of the latent image on photosensitive member 10 is also extremely small. As a result, only extremely small amounts of carrier liquid are absorbed by the paper or other recording medium during transfer. Therefore, if the viscosity is 1,000 mPa.s or less, remaining carrier liquid usually cannot be seen on the paper or other recording medium after fusing. Experiments performed by the inventors showed that, after fusing, remaining carrier liquid could not be seen on the paper or other recording medium when either DC344 from Dow Corning Corporation of America with a viscosity of 2.5 mPa.s or DC345 from Dow Corning Corporation of America with a viscosity of 6.5 mPa.s were used as the carrier liquid for the image printing tests. However, the developing apparatus must have a tightly sealed structure due to the high volatility of these liquids. Further image printing tests were performed using KF-96-20 from Shin-Etsu Silicone Co., Ltd. with a viscosity of 20 mPa.s as the carrier liquid. After fusing, remaining carrier liquid could not be seen on the paper or other recording medium and, furthermore, the volatility is low enough that the developing apparatus does not need a tightly sealed structure. DC344, DC345, and KF-96-20 are all in general use in cosmetic products, have low toxicity, and are extremely safe. There are many types of similar carrier liquids, such as KF9937 from Shin-Etsu Silicone Co., Ltd. Any of these may be selected as long as they meet the electric resistance, vaporisation characteristic, surface tension, safety, and other requirements.

Experiments performed by the inventors showed that fogging and adhesion of clusters of toner can occur if the surface tension is too high. Experiments showed that image quality problems occur easily if the surface tension is 21 dyne/cm or higher.

To avoid stability problems with the electric charge of the toner, an electric resistance value of $10^{14}$ Ωcm or more is desirable and a minimum value of $10^{12}$ Ωcm or more is required. In keeping with the results of these experiments, an example using DC345, which is inexpensive and easy to obtain, is given in the explanation of the first embodiment.

A liquid which does not cause inaccuracies in the electrostatic latent image formed on the image bearing member, that vaporises easily during fusing, and that does not cause fogging or adhesion of clusters of toner is required as the pre-wet liquid. Examples include DC344, DC200-0.65, DC200-1.0, and DC200-2.0 from Dow Corning Corporation of America and KF96L-1 and KF9937 from Shin-Etsu Silicone Co., Ltd. Generally, a silicone oil that vaporises easily should be selected.

Experiments performed by the inventors showed that developing, transfer, and fusing dries the liquid well if the viscosity of the liquid is in the range from 0.5 to 3 mPa.s. However, with viscosities from about 5 to 6 mPa.s, both time and heat tend to be required to dry the liquid during fusing. A viscosity of 10 mpa.s is not normally used because too much energy is required for drying. If the viscosity is 0.5 mPa.s or less, the liquid becomes more volatile and is not suitable because legal constraints regarding the handling of dangerous substances apply. A liquid with a boiling point of 250° C. or less is desirable because paper is affected by the application of heat.

The surface tension should be as low as possible in order to avoid an adhesive force between the developing agent and the image bearing member, to obtain good release properties and prevent the image becoming dirty, and to improve the resolution in the image quality. Experiments performed by the inventors showed that the limit is about 20 to 21 dyne/cm and that selection of a value below this is preferred.

If the electric resistance is too low, the charge of the latent image leaks and the image fades. Therefore, a liquid with an electric resistance that is as high as possible must be used. Experiments showed that an electric resistance of about $10^{14}$ Ωcm or more is desirable and a minimum value of $10^{12}$ Ωcm is required.

Next, the operation of this embodiment of the electrostatic latent image liquid developing apparatus is explained. Firstly, as shown in FIG. 3 (A), pre-wet apparatus 20 applies the above pre-wet liquid 220 to photosensitive member 10. When an external signal is input, pre-wet apparatus 20 moves pre-wet liquid supply element 202 into contact with photosensitive member 10. Pre-wet liquid 220 is circulated continuously inside pre-wet liquid supply element 202 by means of pump 208. The pre-wet liquid 220 that exceeds the capacity of the pores in the Bell-eta used as pre-wet liquid supply element 202 is released from release side 202*b* of pre-wet liquid supply element 202, as shown in FIG. 5, and also from the lower surface of pre-wet liquid supply element 202. This provides a uniform application of the pre-wet liquid to photosensitive member 10 without causing damage to photosensitive member 10.

Figure 3A:
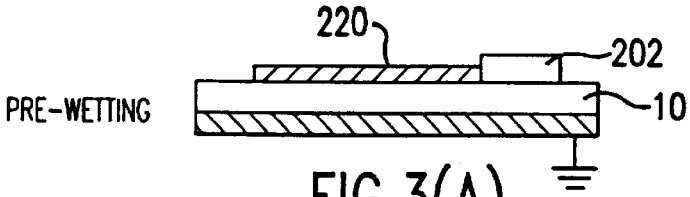
FIGS. 3(A)–3(F) show the operation of the electrostatic latent image liquid developing apparatus shown in FIG. 1.
Figure 3B:
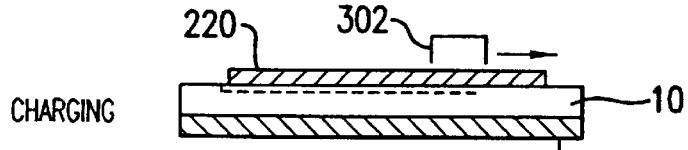
Figure 3C:
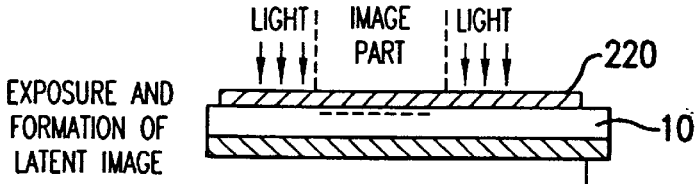

Next, as shown in FIG. 3(B), photosensitive member 10, to which pre-wet liquid 220 has been applied, is given an electric charge by corona discharge device 302. The electric charge is carried by ions which reach the surface of photosensitive member 10 through the medium of the layer of pre-wet liquid. Then, the image on the charged photosensitive member 10 is exposed. A laser scanner, for example, exposes the image and forms an electrostatic latent image on the surface of photosensitive member 10. As shown in FIG. 3(C), the parts that are struck by the light from the laser scanner are made conductive and the electric charge dissipates. The parts that have not been struck by the light are the charged image and remain as the electrostatic latent image.

Figure 3D:
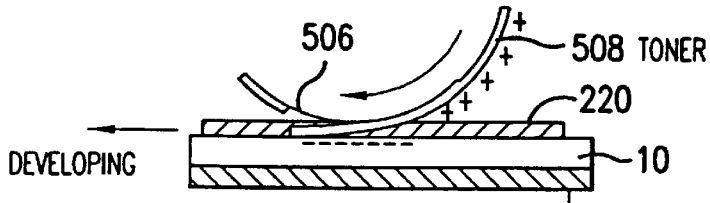

Next, developing apparatus 50 makes the electrostatic latent image into a visible image. The liquid developing agent 508 that has been released from bellows pump 502 and stored in trap 504 is drawn up by developing roller 506, the thickness of the layer is adjusted by regulatory roller 510, and a thin layer is formed on developing roller 506. The liquid developing agent layer formed on developing roller 506 in this way is brought adjacent to the electrostatic latent image formed on the surface of photosensitive member 10, as shown in FIG. 3(D), where the electrostatic force migrates the charged toner to photosensitive member 10. Note that the liquid developing agent 508 that is stored in trap 504 is agitated by the rotation of developing roller 506.

Figure 3E:
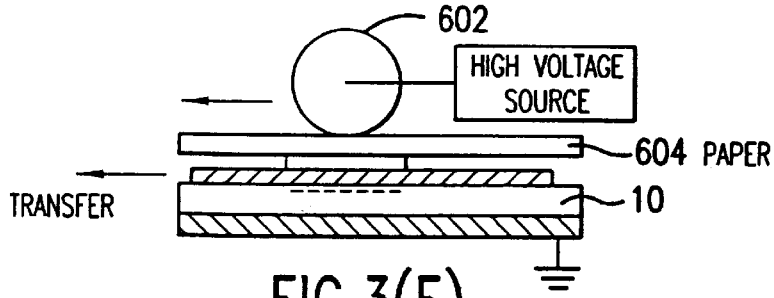
Figure 3F:
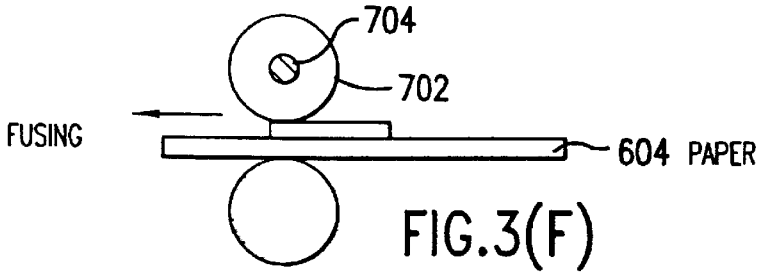

Next, the electrostatic force generated by the voltage applied to transfer roller 602 of transfer apparatus 60 transfers the toner image from photosensitive member 10 to the specified paper 604, as shown in FIG. 3(E). Then, as shown in FIG. 3(F) but not shown in FIG. 1, the fusing heater 704 that is provided within fuser roller 702 of the fusing apparatus thermally fuses the toner that has been transferred to paper 604 and fixes it to the paper. Cleaning apparatus 70 then removes the liquid developing agent 508 remaining on photosensitive member 10. After the charge removal apparatus (not illustrated) neutralises the charge on photosensitive member 10, the photosensitive member can be used again repeatedly for the above cycle from pre-wetting through to charge neutralisation.

Figure 6:
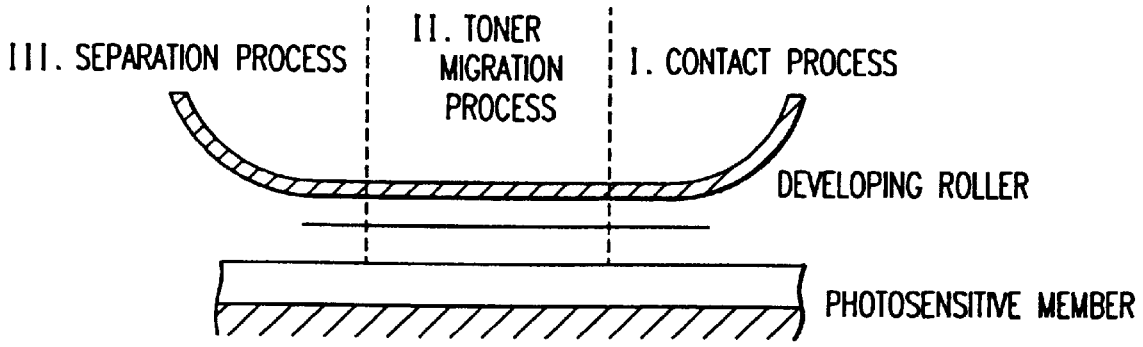
FIG. 6 shows the overall developing process.
Figure 7:
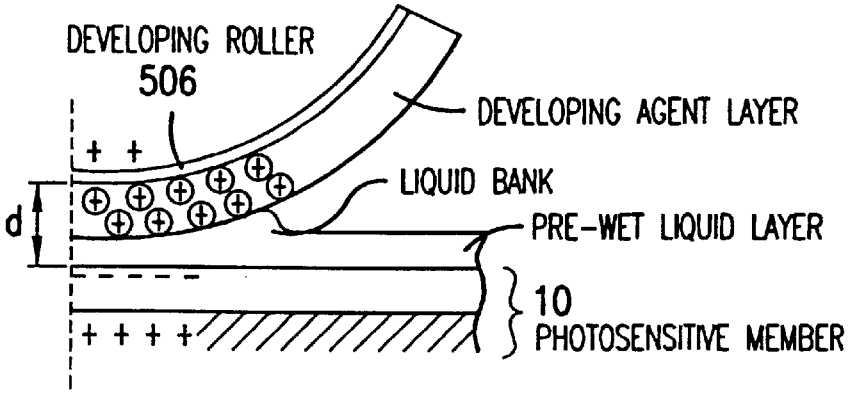
FIG. 7 shows details of the contact process.
Figure 8:
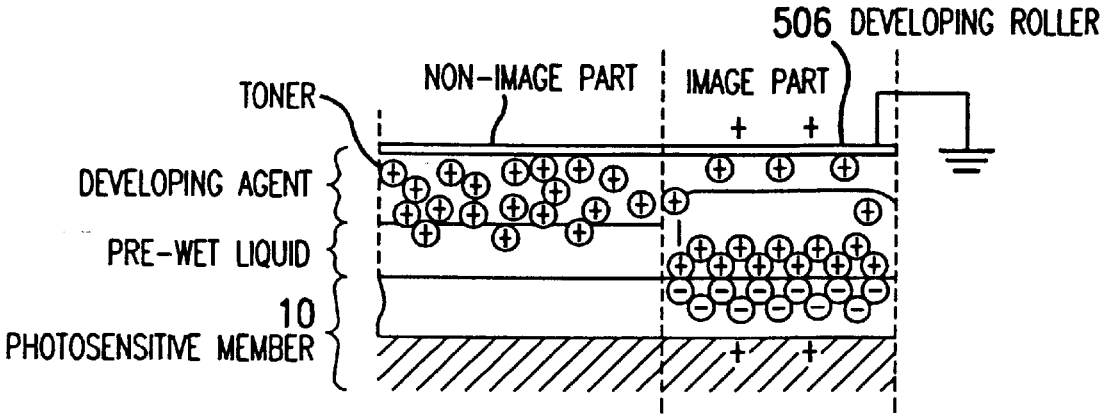
FIG. 8 shows details of the toner migration process.
Figure 9:
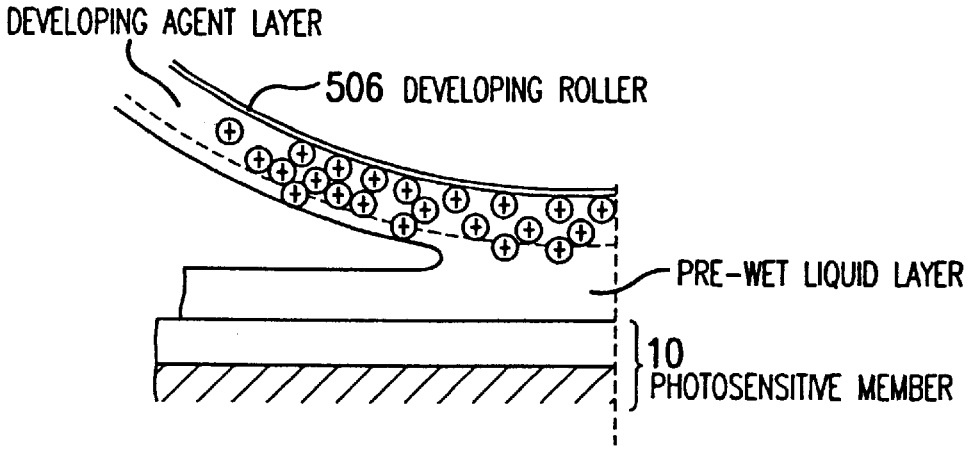
FIG. 9 shows the separation process at non-image parts.
Figure 10:
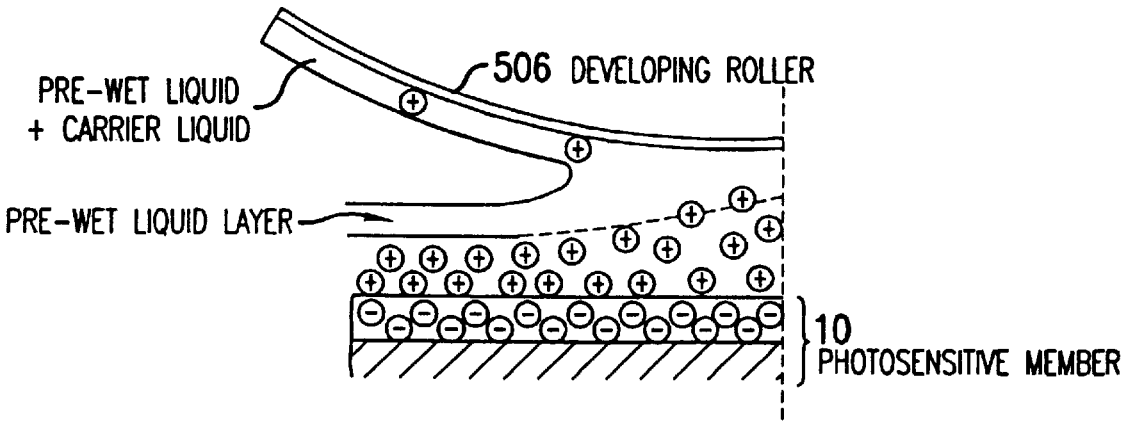
FIG. 10 shows the separation process at image parts.

Drawings 6 to 10 explain the details of the developing process in this embodiment. FIG. 6 explains the overall developing process., FIG. 7 shows the details of the contact process, FIG. 8 shows the details of the toner migration process, FIG. 9 shows the separation process at the non-image parts, and FIG. 10 shows the separation process at the image parts. Unlike developing processes in the related art, the developing process of the first embodiment can be thought of as consisting of the following three processes, as shown in FIG. 6: the contact process in which the developing roller comes close to the photosensitive member and the liquid developing agent comes close to the surface of the photosensitive member; the toner migration process in which the liquid developing agent layer and the pre-wet liquid layer make soft contact, allowing the toner to migrate; and the separation process in which the developing roller separates from the photosensitive member and the toner adhering to the developing roller separates from the toner adhering to the photosensitive member.

Developing roller 506 is constructed from an elastic element. This allows the contact force to be distributed when the liquid developing agent layer on developing roller 506 and the pre-wet liquid layer on photosensitive member 10 touch, as shown in FIG. 7. Thus the highly viscous liquid developing agent, comprised of a carrier liquid and toner, and the pre-wet liquid form a soft contact. During the contact process, a minute gap (d) is formed between developing roller 506 and photosensitive member 10 by means of the liquid developing agent layer and the pre-wet liquid layer. Note that some of the pre-wet liquid, which has the lower viscosity of the two liquids, is pushed out to produce a liquid bank of pre-wet liquid.

During the toner migration process, the electrical field formed between the electric charge on photosensitive member 10 and developing roller 506 causes the toner at the image parts to migrate, as shown in FIG. 8, to the latent image surface through the medium of the pre-wet liquid layer, mainly by means of the Coulomb force.

At the non-image parts, the surface of photosensitive member 10 and the liquid developing agent layer are basically separated by the pre-wet liquid layer and, therefore, unnecessary toner does not adhere to the surface of photosensitive member 10.

During the separation process, the liquid developing agent basically remains on developing roller 506 at the non-image parts, as shown in FIG. 9. When the pre-wet liquid layer and the liquid developing agent layer separate at their interface into two layers, part of the pre-wet liquid layer, which has the lower viscosity, is transferred to the liquid developing agent layer to achieve the separation. Accordingly, the separation point for the two layers can be seen as being a point within the pre-wet liquid layer. At the image parts, the toner that has migrated to the surface of photosensitive member 10 pushes the pre-wet liquid layer away such that the pre-wet liquid layer is located on top of the toner layer and the separation is made at a point within that pre-wet liquid layer, as shown in FIG. 10. Some of the carrier liquid that remains on developing roller 506 after the toner has migrated and some of the pre-wet liquid form a layer. The pre-wet liquid remaining on photosensitive member 10 can be moved easily during the subsequent transfer process by the electrostatic force of the toner.

Figure 11:
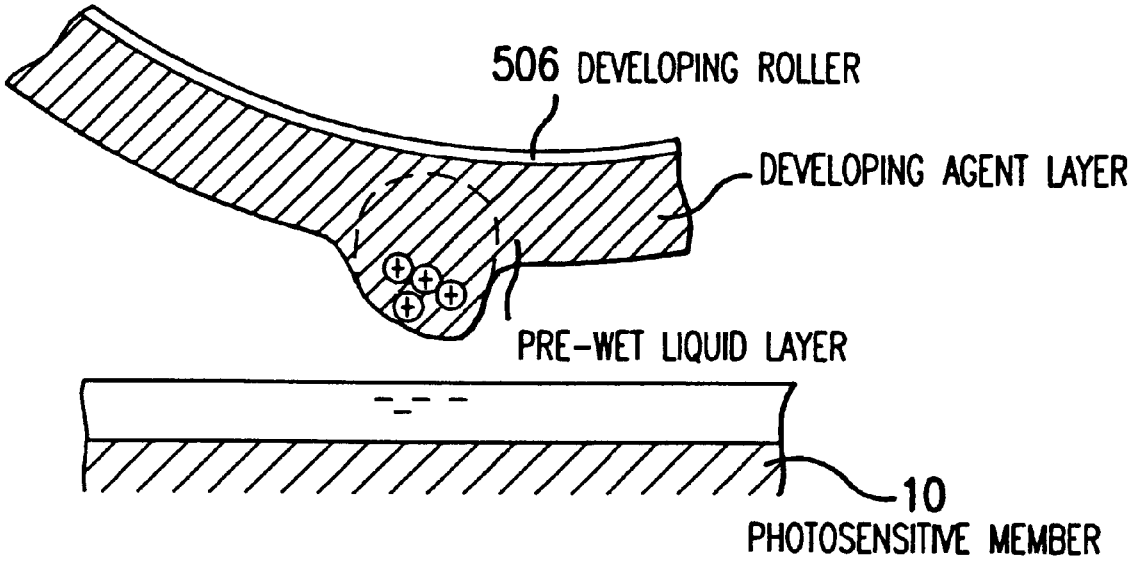
FIG. 11 shows the significance of applying the liquid developing agent as a thin layer.

FIG. 11 explains the significance of the liquid developing agent being in the form of a thin film. If the layer of liquid developing agent applied to developing roller 506 is too thick, the high viscosity of liquid developing agent 508 causes excessive toner adherence, which produces image noise. This is because, when the electrostatic force moves a toner selection from developing roller 506 to the surface of photosensitive member 10, the surrounding toner adheres to the toner selection to form a cluster which moves to photosensitive member 10 along with the target toner selection. To suppress the formation of such clusters, the value of the minimum layer thickness of liquid developing agent layer that will provide good developing results must be determined.

Figure 12:
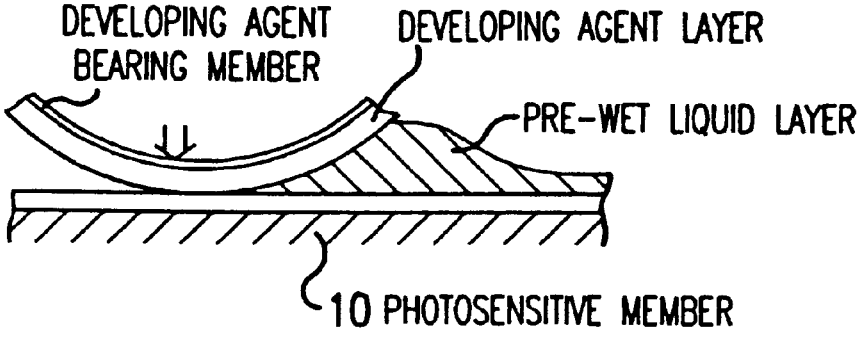
FIG. 12 shows hard contact between a developing roller and a photosensitive member.
Figure 13:
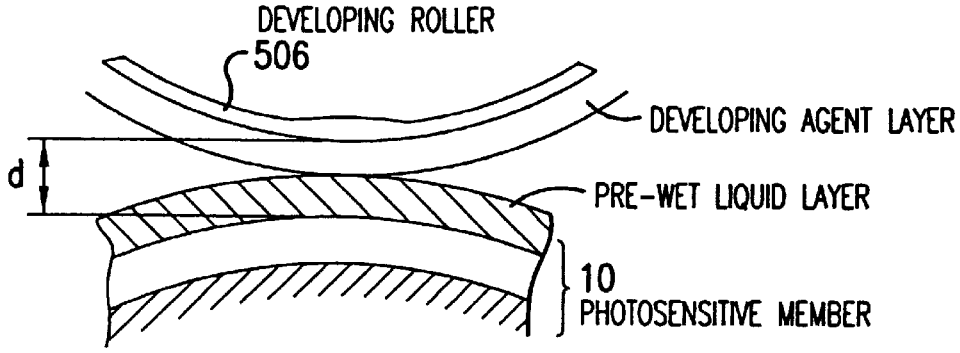
FIG. 13 shows the soft contact used by the method in this invention.

FIG. 12 shows how hard contact is made between a developing agent bearing member and a photosensitive member, and FIG. 13 explains the soft contact achieved in this embodiment. As explained above, the function of the pre-wet liquid layer during the developing process is of major importance to image formation in the first embodiment. Accordingly, maintenance of the two-layer structure of the pre-wet liquid layer and the liquid developing agent layer is an important pre-condition of the developing process. If the developing agent bearing member and the photosensitive member are brought into hard contact as shown in FIG. 12, the two-layer structure cannot be maintained. Therefore, in this embodiment, the elastic developing roller 506 is used as the developing agent bearing member such that the pushing force of developing roller 506 against photosensitive member 10 is regulated and the contact force is distributed when the liquid developing agent layer on developing roller 506 and the pre-wet liquid layer on photosensitive member 10 touch. Minute gap d is formed between developing roller 506 and photosensitive member 10 by means of the liquid developing agent layer and the pre-wet liquid layer, as shown in FIG. 13. As a result, the liquid developing agent layer and pre-wet liquid layer can be made to touch in the developing area while maintaining a two-layer structure that allows the two layers to be distinguished from each other.

Next, optimization of the liquid developing agent layer thickness, pre-wet layer thickness, and the developing gap is explained. The liquid developing agent layer must be thin if the viscosity of the liquid developing agent is 50 to 100 mPa.s or higher, and particularly so if the viscosity is 500 mPa.s or higher. The ideal layer thickness is just a little thicker than the layer thickness that can supply the toner developing capacity (that is, the concentration when a large area is black) required during developing. This is because, when a highly viscous liquid developing agent is used, the electrostatically selected toner brings neighbouring toner along with it when migrating to the photosensitive member during developing due to the viscosity of the liquid. This results in the adhesion of superfluous toner and causes images to become dirty. The experiments performed by the inventors concerning developing agents with high toner concentrations showed that good images can be obtained using layer thicknesses starting from 5 $\mu$m, and using up to about 40 $\mu$m for comparatively lower toner concentrations. In addition, if a developing agent with a toner concentration of 20 to 30% is used, good image quality can be obtained using toner layer thicknesses of about 8 to 20 $\mu$m.

The optimum value for the thickness of the pre-wet liquid layer depends on the viscosity and surface tension of the selected pre-wet liquid. If the layer is too thin, the highly viscous liquid developing agent adheres to the photosensitive member in a disorderly manner, which causes images to become dirty. The optimum value can be confirmed if the images become cleaner as the quantity of pre-wet liquid is increased. As the quantity of pre-wet liquid is increased even further, the latent image electric charge flows causing the clarity and resolution to deteriorate, the toner spreads during developing, and the image tends to fade. In experiments in which DC344 was used, good results were obtained with thicknesses of 30 μm or less, and even better results with thicknesses of 20 μm or less. With liquids with even lower viscosities, good results can be obtained with both thinner and thicker layers. The range of optimum values tends to be narrower with more highly viscous liquids.

As with the developing methods in related art, the image quality attributes of resolution and the uniformity of the density in solid parts improves as the gap between the photosensitive member and the developing roller is made smaller. When powder developing agents are used, the toner to be used for developing is freed from the developing agent bearing member or carrier particles by mechanical impact and electrostatic force. However, in the highly viscous liquid developing agent used in the first embodiment, the adhesive force between the toner particles is too strong to allow use of this type of developing. In other words, developing does not take place through the medium of an air space between the liquid developing agent layer and the photosensitive member. Rather, contact between the developing roller and liquid developing agent layer, the liquid developing agent layer and the pre-wet liquid layer, and the pre-wet liquid layer and the photosensitive member is mandatory. Therefore, developing gap d must be no larger than the sum of the thicknesses of the developing agent layer and the pre-wet liquid layer, but large enough to avoid disturbing the layers. In this embodiment, the pushing force of developing roller 506 against photosensitive member 10 was set in accordance with differences in the hardness of developing roller 506, the developing agent viscosity, and the toner concentration such that, when the pre-wet liquid layer on photosensitive member 10 and the liquid developing agent layer on developing roller 506 touch, gap d is from 8 μm to 50 μm.

Table 1 shows the results of image printing experiments performed under the above conditions. These results indicate that the most suitable viscosity ranges for the developing agent and the pre-wet liquid in the developing method of the first embodiment are developing agent viscosity values from 100 mPa.s to 6,000 mPa.s and pre-wet liquid viscosity values from 0.5 to 5 mPa.s. The image quality is affected by the thickness of the layer of liquid developing agent on the developing roller, the thickness of the pre-wet liquid layer, the developing gap, and other factors, but even if the various developing conditions are optimised, the general trends shown in Table 1 apply, and the test results confirm that the optimum characteristics for the liquid developing agent are within the range shown in Table 1. The Dow Corning DC200 series was used as the pre-wet liquid silicone oil, and Dow Corning DC345 was used as the carrier liquid in the developing agent.

TABLE 1

| Viscosity of developing agent | Toner concentration | Viscosity of pre-wet liquid (mPa · s) | | | | |
|---|---|---|---|---|---|---|
| (mPa · s) | (%) | 0.65 | 1.5 | 3.0 | 5.0 | 10 |
| 50 | 5 | Image density tends to be low, and the uniformity of the toner distribution deteriorates slightly | | | | Vaporisation of oil remaining |

TABLE 1-continued

| Viscosity of developing agent | Toner concentration | Viscosity of pre-wet liquid (mPa · s) | | | | |
|---|---|---|---|---|---|---|
| (mPa · s) | (%) | 0.65 | 1.5 | 3.0 | 5.0 | 10 |
| 100 | 10 | Density tends to be slightly low | | | Vaporisation of oil reamining on the paper is slow (practial limit) | on the paper is too slow to be practical |
| 500 | 20 | Good quality images (both density and resolution) can be obtained | | | | |
| 1,000 | 22 | | | | | |
| 2,000 | 25 | | | | | |
| 3,000 | 30 | | | | | |
| 6,000 | 40 | | | | | |

In the first embodiment of this invention, the elastic developing roller 506 is rotated in the driven direction in relation to photosensitive member 10 and, at the same time, the layer of liquid developing agent on developing roller 506 is brought into contact with the layer of pre-wet liquid on photosensitive member 10. This produces elastic deformation in developing roller 506 in the developing area and allows the contact force to be distributed when the liquid developing agent layer on developing roller 506 touches the pre-wet liquid layer on photosensitive member 10. As a result, the liquid developing agent layer and pre-wet liquid layer maintain a two-layer structure in the developing area. This prevents excessive squashing of the liquid developing agent layer, prevents adhesion of toner to the non-image parts on photosensitive member 10, and thereby prevents image inaccuracies.

In addition, the surface of developing roller 506 in the first embodiment of this invention is provided with surface layer 506*c*. This layer is formed from a conductive material that is not caused to swell by the silicone oil used as the carrier liquid in liquid developing agent 508. Thus, liquid developing agent 508 is not absorbed or released when elastic deformation of developing roller 506 occurs in the developing area, and disturbance of the pre-wet liquid layer on photosensitive member 10 can be prevented. In this way, occurrence of inaccuracies in the toner images formed on photosensitive member 10 can be avoided.

Further, in the first embodiment of this invention, pressure-limiting rollers 507 are provided at both ends of developing roller 506 such that the pressure-limiting rollers contact photosensitive member 10. The external diameter of pressure-limiting rollers 507 can be changed in order to regulate the contact force of developing roller 506 against photosensitive member 10. This allows easy distribution of the contact pressure when the layer of liquid developing agent formed on developing roller 506 touches the layer of pre-wet liquid formed on photosensitive member 10.

In addition, in the first embodiment of this invention, silicone oil is used as the carrier liquid in the liquid developing agent. In comparison with the carrier liquids in the related art, silicone oil has the advantages described below.

In the liquid developing agents in related art, IsoparG (registered trademark of the Exxon Corporation) is generally used as the carrier liquid. Since the resistance value for Isopar is not as high as for silicone oil, the toner charge properties deteriorate as the toner concentration is increased, that is, as the space between particles becomes smaller. Accordingly, the toner concentration levels in Isopar are limited. In contrast, the silicone oil used in this embodiment has a sufficiently high resistance value to allow increases in the toner concentration. Generally, the toner disperses well in Isopar and, therefore, the toner particles tend to repel each other even when the toner concentration is 1 to 2%, allowing uniform toner dispersion. In contrast, toner does not disperse well in silicone oil at concentrations of 1 to 2% and precipitates easily. However, if the toner concentration is increased to a level from 5 to 40%, the toner becomes tightly packed and disperses evenly. Thus, a highly viscous liquid developing agent in which the toner is very densely dispersed is used in this embodiment. As a result, the volume of developing liquid can be greatly reduced in comparison with the low-concentration liquid developing agents in the related art, and reduction in the size of the apparatus can be achieved. Furthermore, since the liquid developing agent used in this embodiment is a highly viscous liquid, handling and storage is easier than with the low-viscosity liquid developing agents and powder developing agents of related art.

The Isopar used in the liquid developing agents in the related art is highly volatile and releases an unpleasant odour, as mentioned above. This adversely affects the work environment and causes environmental problems. In contrast, the silicone oil used in this embodiment is a safe liquid, as amply evidenced by its use in cosmetic products, and is odorless. Thus, use of this embodiment can improve the work environment and avoid environmental problems.

Figure 18:
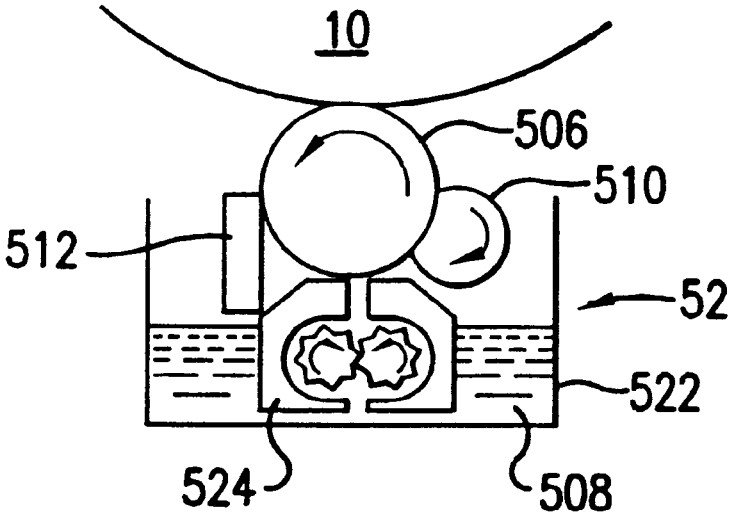
FIG. 18 shows an example of modifications to the developing apparatus shown in FIG. 15.

Bellows pump 502 is used in the above embodiment as the means of supplying liquid developing agent 508 to developing roller 506, as already explained, but note that this invention is not restricted in this matter. Double gear pump 524, for example, may be disposed such that it is immersed in the liquid developing agent 508 that is stored in tank 522, as in developing apparatus 52 shown in FIG. 18, and be used to draw up the liquid developing agent 508 that is stored in tank 522 in order to supply the liquid developing agent to developing roller 506.

Figure 19:
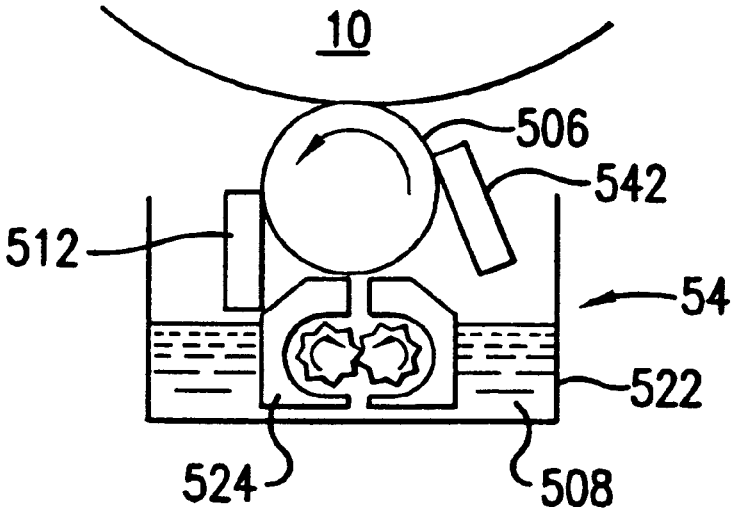
FIG. 19 shows another example of modifications to the developing apparatus shown in FIG. 15.

In addition, the use of regulatory roller 510 in the above embodiment to regulate the thickness of and form a thin layer of the liquid developing agent 508 that has been applied to developing roller 506 has already been explained, but this invention is not restricted in this matter. A regulatory blade 542 formed from rubber or a rigid material, for example, may be used, as in developing apparatus 54 shown in FIG. 19, to regulate the thickness of and form a thin layer of the liquid developing agent 508 that has been applied to developing roller 506. Experiments performed by the inventors showed that a uniform thin film of developing agent can be formed by a design wherein the method of contact between regulatory blade 542 and developing roller 506 is such that they touch in the trailing direction and the front end of regulatory blade 542 protrudes beyond the contact face of the regulatory blade and the developing roller.

In the above explanations of the first embodiment, pre-wet apparatus 20 applies pre-wet liquid 220 to photosensitive member 10 before charging apparatus 30 charges photosensitive member 10, but this invention is not restricted in this matter. Pre-wet liquid 220 may be applied at any time before the developing process begins.

Next, the second embodiment of this invention is explained with reference to FIG. 20.

Figure 20:
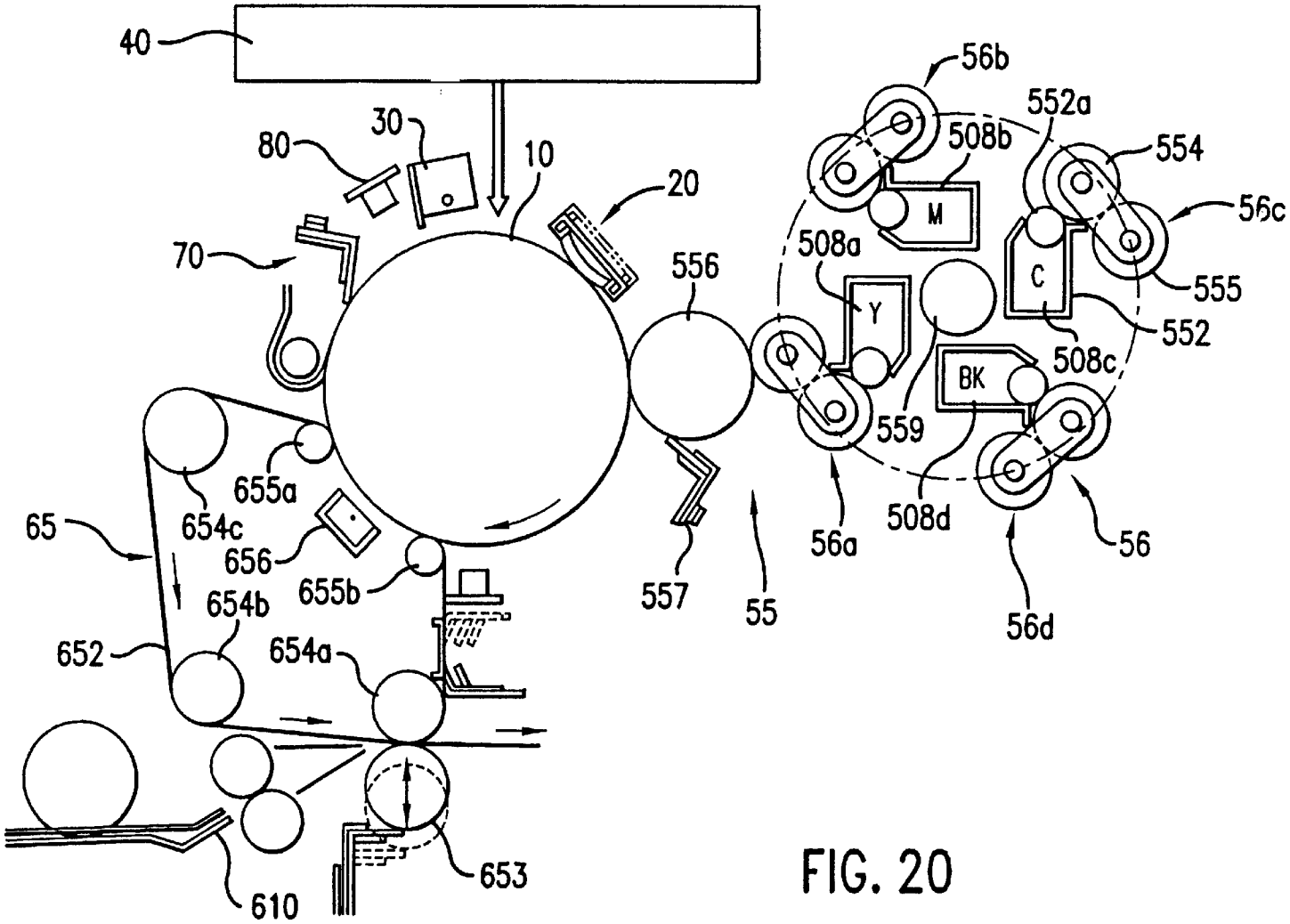
FIG. 20 is an overview of the structure of the electrostatic latent image liquid developing apparatus in the second embodiment of this invention.

FIG. 20 shows an overview of the structure of the electrostatic latent image liquid developing apparatus that is the second embodiment of this invention. Note that the components shown in FIG. 20 that have the same function as components in the first embodiment are given the same reference numbers.

The electrostatic latent image liquid developing apparatus that is the second embodiment, shown in FIG. 20, is provided with photosensitive member 10, which is the image bearing member, pre-wet apparatus 20 that applies pre-wet liquid to photosensitive member 10, charging apparatus 30 that gives an electric charge to photosensitive member 10, exposure apparatus 40 that exposes the image on photosensitive member 10, developing apparatus 55 that makes a visible image from an electrostatic latent image by means of supplying toner to the parts on photosensitive member 10 where the electrostatic latent image is formed, transfer apparatus 65 that transfers the toner on photosensitive member 10 to the prescribed paper and, at the same time, fixes the toner to the paper, paper feed apparatus 610 that carries the specified paper to transfer apparatus 65, cleaning apparatus 70 that removes toner that has adhered to photosensitive member 10, and charge removal apparatus 80 that neutralises the charge on the electrically charged photosensitive member 10.

The parts of the second embodiment of the electrostatic latent image liquid developing apparatus that differ from the first embodiment of the electrostatic latent image liquid developing apparatus are developing apparatus 55 and transfer apparatus 65. The other parts are either the same as in the first embodiment, or the conventional technology used in the electrophotographic printers in the related art can be used, in most cases. Therefore, details of developing apparatus 55 and transfer apparatus 65 of the second embodiment are explained but explanations for the other parts are omitted.

Developing apparatus 55 in the second embodiment is provided with developing roller 556, which is the developing agent bearing member, supply apparatus that applies liquid developing agent 506 to developing roller 556, and scraper blade 557 that removes the excess liquid developing agent 508 adhering to developing roller 556 after developing.

Supply apparatus 56 is provided with four developing cartridges, 56*a*, 56*b*, 56*c*, and 56*d* (hereafter referred to simply as the developing cartridges), on rotating axis 559. Each cartridge is provided with tank 552 that stores liquid developing agent 508, supply roller 552*a* provided at the release aperture of tank 552, transport roller 554 provided such that it contacts supply roller 552*a*, and application roller 555 provided such that it contacts transport roller 554. Liquid developing agent 508*a* in tank 552 of developing cartridge 56*a* contains yellow toner, liquid developing agent 508*b* in tank 552 of developing cartridge 56*b* contains magenta toner, liquid developing agent 508*c* in tank 552 of developing cartridge 56*c* contains cyan toner, and liquid developing agent 508*d* in tank 552 of developing cartridge 56*d* contains black toner. (Hereafter, liquid developing agents 508*a* to 508*d* are all referred to simply as liquid developing agent 508.) Supply apparatus 506 rotates rotating axis 559 to rotationally move the developing cartridges and thereby brings the application roller of any particular one of the developing cartridges into contact with developing roller 556. In this way, liquid developing agent 508 containing toner of the desired colour is applied to developing roller 556.

Supply roller 552*a* is rotated in the opposite direction to the direction of rotation of transport roller 554, thereby supplying liquid developing agent 508 to transport roller 554. Transport roller 554 is rotated in the opposite direction to the direction of rotation of application roller 555, thereby transporting the liquid developing agent 508 that has been supplied by supply roller 552*a* to application roller 555.

Application roller 555 is rotated in the opposite direction to the direction of rotation of developing roller 556, thereby applying the liquid developing agent 508 that has been transported by transport roller 554 to the surface of developing roller 556. Transport roller 554 and application roller 555 are used to supply liquid developing agent 508 to developing roller 556 because the toner is dispersed at a high concentration in liquid developing agent 508, making large quantities of developing agent unnecessary. This means that small quantities of liquid developing agent must be applied thinly and evenly to the surface of developing roller 556. Note that one or more extra transport rollers that transport liquid developing agent 508 may be provided between transport roller 554 and application roller 555.

Developing roller 556 is rotated in the opposite direction to the direction of rotation of photosensitive member 10 and thereby supplies liquid developing agent 508 to the surface of the latent image on photosensitive member 10. The elasticity and conductivity of developing roller 556 is the same as for developing roller 506 in the first embodiment. Therefore, a detailed explanation of developing roller 556 is omitted.

Transfer apparatus 65 of the second embodiment is provided with intermediate transfer belt 652, which is an intermediate transfer member, drive rollers 654*a*, 654*b*, and 654*c* that provide the rotational drive for intermediate transfer belt 652, support rollers 655*a* and 655*b* that support intermediate transfer belt 652 such that part of the belt contacts photosensitive member 10, corona discharge apparatus 656 that gives to intermediate transfer belt 652 an electric charge of opposite polarity to the toner, and second-stage transfer roller 653, which is a second-stage transfer member, provided such that it can be moved away from intermediate transfer belt 652.

Intermediate transfer belt 652 is rotated in the opposite direction to the direction of rotation of photosensitive member 10 by drive rollers 654*a*, 654*b*, and 654*c*. A flexible belt element is used as intermediate transfer belt 652. For example, a metal belt such as a seamless nickel belt, a resin belt such as a polyimide film belt or PET film belt, or a rubber belt can be used. This allows the contact pressure to be distributed when intermediate transfer belt 652 touches the toner image formed on photosensitive member 10. Note that, if a resin or rubber belt is used, a conductive process for the belt surface or addition of minute conductive particles to the belt material is required in order to obtain the desired electric resistance value.

A surface layer of teflon, silicone, or other material with good release properties is formed on intermediate transfer belt 652. This weakens the physical adhesive strength between the toner and intermediate transfer belt 652 and facilitates migration of the toner to the paper.

Second-stage transfer roller 653 is rotated in the opposite direction to the direction of rotation of intermediate transfer belt 652 such that the paper carried by paper feed apparatus 610 is fed between intermediate transfer belt 652 and second-stage transfer roller 653. At this time, second-stage transfer roller 653 is pressed against intermediate transfer belt 652 through the medium of the paper. A second-stage transfer bias is added to second-stage transfer roller 653 and the toner image formed on intermediate transfer belt 652 is transferred to the paper. The toner image is then fixed to the paper by the fuser apparatus (not shown in the drawings). Note that a fusing heater may be provided inside drive roller 654*a* to add heat to the toner on intermediate transfer belt 652 such that the toner image formed on intermediate transfer belt 652 is fused at the same time as it is transferred to the paper. Fusing heaters may be provided inside both drive roller 654*a* and second-stage transfer roller 653.

The electrostatic latent image liquid developing apparatus of this embodiment first uses charging apparatus 30 to charge photosensitive member 10, then uses exposure apparatus 40 to expose the image on photosensitive member 10 and form the electrostatic latent image. Then, pre-wet apparatus 20 applies pre-wet liquid 220 to the surface of photosensitive member 10, and developing apparatus 55 makes a visible image from the electrostatic latent image formed on photosensitive member 10. The liquid developing agent 508 stored in tank 552 is supplied to transport roller 554 by supply roller 552*a*, transported to application roller 555 by transport roller 554, then applied to developing roller 556 by application roller 555. The liquid developing agent 508 transported to developing roller 556 by means of rollers in this way is applied thinly and uniformly to developing roller 556, thus forming a thin film on developing roller 556. Supply apparatus 506 rotates rotating axis 559 to rotationally move the developing cartridges and thereby brings the application roller 555 of any particular one of developing cartridges 56*a* to 56*d* into contact with developing roller 556. In this way, liquid developing agent 508 containing either yellow, magenta, cyan, or black toner is applied thinly and evenly to developing roller 556.

Next, the liquid developing agent layer formed on developing roller 556 is brought into contact with the electrostatic latent image formed on the surface of photosensitive member 10. The electrostatic force causes the charged toner to migrate to photosensitive member 10 to form the toner image.

Then, transfer apparatus 65 performs the first-stage transfer in which the toner image formed on photosensitive member 10 is transferred to intermediate transfer belt 652, which is the intermediate transfer member. In the first-stage transfer, the toner image formed on photosensitive member 10 is caused to migrate to intermediate transfer belt 652 by means of the electrostatic force generated between the toner image formed on photosensitive member 10 and intermediate transfer belt 652, which has been given a charge of opposite polarity to the toner by corona discharge apparatus 656. At this point, the remaining liquid developing agent 508 on photosensitive member 10 is removed by cleaning apparatus 70, and then the charge is neutralised by charge removal apparatus 80. Then, the developing cartridges are rotationally moved such that a different developing cartridge contacts developing roller 556 and the above cycle, from charging through to charge removal, is repeated.

In this way, the yellow, magenta, cyan, and black toner images are transferred sequentially and overlayed on intermediate transfer belt 652 to form a toner image in colour on intermediate transfer belt 652.

Next, transfer apparatus 65 performs the second-stage transfer in which the colour image that has been formed on intermediate transfer belt 652 is transferred to the paper used as the recording medium. To achieve this second-stage transfer, the colour toner image that has been formed on intermediate transfer belt 652 is released from the intermediate transfer belt 652 surface layer, which has good release properties, by means of the pushing force of second-stage transfer roller 653 against intermediate transfer belt 652 and by means of the bias voltage added to second-stage transfer roller 653 and is migrated to the paper that is fed between intermediate transfer belt 652 and second-stage transfer roller 653 by paper feed apparatus 610. The fuser apparatus, not shown in the drawings, then thermally fuses and fixes to the paper the colour toner image transferred in the second-stage transfer. In this way, colour images can be formed on the paper. Note that if a fusing heater is provided inside drive roller 654*a* and/or second-stage transfer roller 653 and heat is applied to the toner on intermediate transfer belt 652, the toner image formed on intermediate transfer belt 652 can be transferred to the paper and fixed at the same time.

In the second embodiment of this invention, the colour liquid developing agents 508*a* to 508*d* are supplied to developing roller 556 from the multiple developing cartridges 56*a* to 56*d* which are moved rotationally such that the developing cartridge that contacts developing roller 556 is switched in sequence during developing.

This means that only one developing agent bearing member is required and, therefore, the size of the electrostatic latent image liquid developing apparatus can be reduced.

In the above description of the second embodiment, a developing apparatus in which the developing cartridges 56*a* to 56*d* attached to rotating axis 559 are moved rotationally in order to sequentially switch the developing cartridge application roller 555 that is in contact with developing roller 556 was explained, but this invention is not restricted in this matter. Any developing apparatus that allows developing cartridges 56*a* to 56*d* to be selectively brought into contact with developing roller 556 may be used. For example, developing cartridges 56*a* to 56*d* may be moved in parallel in order to switch the developing cartridge application roller 555 that is in contact with developing roller 556.

In the second embodiment described above, a developing apparatus that is provided with developing cartridge 56*a* that supplies liquid developing agent 508*a* containing yellow toner to developing roller 556, developing cartridge 56*b* that supplies liquid developing agent 508*b* containing magenta toner to developing roller 556, developing cartridge 56*c* that supplies liquid developing agent 508*c* containing cyan toner to developing roller 556, and developing cartridge 56*d* that supplies liquid developing agent 508*d* containing black toner to developing roller 556 is described, but this invention is not restricted in this matter. Two or three developing cartridges that supply liquid developing agent containing the desired colour of toner to the developing roller may be used, as required, for the developing apparatus.

Further, in the second embodiment described above, developing apparatus developing cartridges in which the liquid developing agent 508 supplied to transport roller 554 by supply roller 552*a* is transported to application roller 555 then applied by application roller 555 are described, but this invention s not restricted in this matter. Any developing cartridge in which a roller is used to supply liquid developing agent 508 to the developing roller may be used. In addition, use of supply roller 552*a* is not the only means of supplying liquid developing agent 508 to transport roller 554. A bellows pump, for example, may be used to supply the liquid developing agent to transport roller 554.

In the second embodiment described above, a developing apparatus in which scraper blade 557 is used to remove the liquid developing agent 508 adhering to developing roller 556 is described, but this invention is not restricted in this matter. A developing apparatus in which a scraper roller is positioned such that it contacts the developing roller may be used to remove the liquid developing agent 508 adhering to the developing roller.

In addition, in the above description of the second embodiment, a sequence in which exposure apparatus 40 exposes an image, then pre-wet apparatus 20 applies pre-wet liquid 220 to photosensitive member 10 is described, but this invention is not restricted in this matter. Pre-wet liquid 220 may be applied before the developing process starts.

In the second embodiment described above, a transfer apparatus in which a first-stage transfer process transfers the toner image formed on photosensitive member 10 to an intermediate transfer member, then the toner image transferred to the intermediate transfer member by this first-stage transfer is transferred to the recording medium by a second-stage transfer process is described, but this invention is not restricted in this matter. Any transfer apparatus that can transfer the toner image formed on photosensitive member 10 to the recording medium can be used. In addition, electrostatic transfer was described for the first-stage transfer to the intermediate transfer member, but an adhesive agent and adhesive transfer may be used.

This invention is not restricted to the embodiments described above. Various modifications are possible within the scope of the essential points. For example, in the embodiments described above, a pre-wet apparatus in which pre-wet liquid 220 circulates continuously inside pre-wet liquid supply element 202 is described, but this invention is not restricted in this matter. A pre-wet apparatus in which pre-wet liquid is supplied to the pre-wet liquid supply element only at the time of pre-wetting may be used.

Figure 14A:
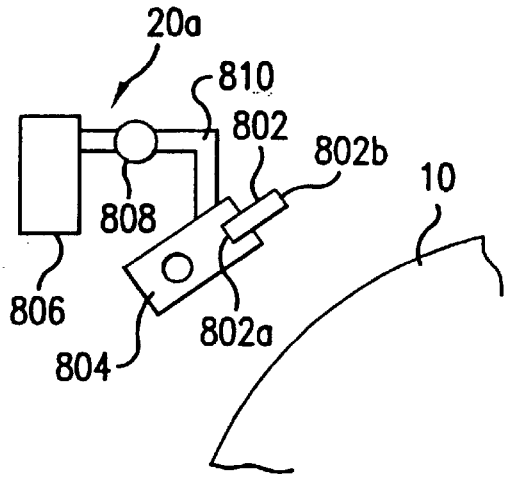
FIG. 14(A)–14(B) show examples of modifications to the pre-wet apparatus shown in FIG. 2.
Figure 14B:
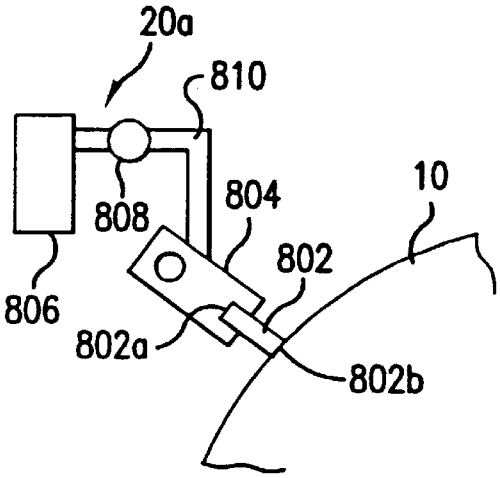

FIG. 14 shows a modification to the pre-wet apparatus in the electrostatic latent image liquid developing apparatus in the embodiments described above. The pre-wet apparatus 20*a* shown in FIG. 14 is provided with a plate-shaped pre-wet liquid supply element 802 that is roughly as long as the width of the image created on photosensitive member 10, casing 804 that houses the supply edge 802*a* of pre-wet liquid supply element 802, tank 806 that stores pre-wet liquid 220, pump 808 that, on the basis of an externally input signal, draws up the pre-wet liquid 220 that is stored in tank 806, tube 810, and position changing apparatus (not illustrated). Tube 810 carries the pre-wet liquid 220 that is drawn up by pump 808 to supply edge 802*a* of pre-wet liquid supply element 802. Note that an empty space is formed between casing 804 and supply edge 802*a* of pre-wet liquid supply element 802. Pre-wet liquid 220 accumulates in this empty space before being supplied from supply edge 802a. The position changing apparatus holds pre-wet liquid supply element 802 in the separated position from photosensitive member 10, as shown in FIG. 14(A), when an external signal is not input. When an external signal is input, pre-wet liquid supply element 802 contacts photosensitive member 10, as shown in FIG. 14(B). When an external signal is input, pre-wet apparatus 20*a* supplies pre-wet liquid 220 to pre-wet liquid supply element 802 by means of pump 208 and, at the same time, moves release edge 802*b* of pre-wet liquid supply element 802 into contact with photosensitive member 10 by means of the position changing apparatus. Pre-wet liquid 220 in excess of the capacity of the pores in the Bell-eta (registered trademark of Kanebo, Ltd.) used as pre-wet liquid supply element 802 is released from release edge 802*b* of pre-wet liquid supply element 802 and applied to photosensitive member 10. In this way, a uniform thickness of pre-wet liquid can be applied without causing damage to the surface of the photosensitive member.

Note that large amounts of pre-wet liquid can be retained by the pre-wet liquid supply element if the Bell-eta (registered trademark) used for the pre-wet liquid supply element has a large pore capacity. This causes a time lag between commencement of the supply of pre-wet liquid to the pre-wet liquid supply element and commencement of pre-wet liquid application to the surface of the photosensitive member. Accordingly, it is desirable that the length of the pre-wet liquid supply element 802 in the direction of flow of pre-wet liquid 220 be as short as possible.

In the descriptions of pre-wet apparatus in the above embodiments, use of a pre-wet liquid supply element formed from continuously porous sponge material to apply pre-wet liquid to the surface of the photosensitive member is described, but this invention is not restricted in this matter. Any pre-wet apparatus that can evenly apply a fixed quantity of pre-wet liquid to the surface of the photosensitive member may be used. For example, the pre-wet liquid may be discharged from multiple radial nozzles and applied, a sponge roller may be used to apply the pre-wet liquid, or a rubber roller may be used to apply the pre-wet liquid.

Further, in the descriptions of the above embodiments, use of silicone oil as the main component of the pre-wet liquid is described, but this invention is not restricted in this matter. As long as the pre-wet liquid has a viscosity from 0.5 to 5 mPa.s, an electric resistance of $10^{12}\Omega$cm or more, boiling point from 100 to 250° C., and a surface tension of 21 dyne/cm or less, a liquid that does not have silicone oil as the main component may be used. Furthermore, if the surface of the image bearing member is coated with a material that has good release properties, a pre-wet apparatus is not particularly necessary.

For the above embodiments, apparatus that uses an organic photosensitive member as the image bearing member has been explained, but this invention is not restricted in this matter. The image bearing member may be any of the photosensitive members used with the Carlson method, may be the type of member used with ionographic or similar methods in which an insulating layer is formed on a conductive body that forms the electrostatic latent image directly, or may be the type of electrostatic recording paper used with electrostatic plotters.

This invention is not restricted to the embodiments described above. If the thickness of the layer of developing agent is from 5 to 40 $\mu$m, the viscosity of the highly viscous developing agent may be 10,000 mPa.s. Currently, if a highly viscous developing agent has a viscosity of 6,000 mPa.s or more, the carrier liquid and toner are difficult to stir. Therefore, such viscosities are considered unsuitable for cost reasons. However, developing agents with viscosities over 6,000 mPa.s may be used if they can be obtained cheaply. Use of viscosities in excess of 10,000 mPa.s is not realistic. The carrier liquid in the liquid developing agent is not restricted to silicone oil.

Industrial Field of Utilisation

In the electrostatic latent image liquid developing method of this invention, the elastic cylindrical developing agent bearing member is rotated in the driven direction in relation to the image bearing member and, at the same time, the layer of liquid developing agent on the developing agent bearing member is brought into contact with the image bearing member, thereby allowing the contact force to be distributed when the liquid developing agent layer on the developing agent bearing member touches the image bearing member. Thus, this method prevents excessive squashing of the liquid developing agent layer in the developing area on the developing agent bearing member, thereby preventing adhesion of the toner to the non-image parts on the image bearing member and preventing the occurrence of image inaccuracies. Moreover, since the toner is dispersed at a high concentration and only a thin layer of liquid is used for the developing process, this invention provides an electrostatic latent image liquid developing method with which high-resolution images can be obtained easily using apparatus of reduced size and without release of polluting gases.

If rollers with a slightly smaller external diameter than the external diameter of the developing agent bearing member are provided at both ends of the developing agent bearing member such that the rollers contact the image bearing member and thereby regulate the contact force of the developing agent bearing member against the image bearing member, this invention can provide an electrostatic latent image liquid developing method that easily regulates the contact pressure when the liquid developing agent layer on the developing agent bearing member touches the image bearing member.

In addition, if the surface, at least, of the developing agent bearing member is formed from a conductive material that does not absorb the liquid developing agent, the developing agent bearing member does not absorb or release the liquid developing agent when elastic deformation of the developing agent bearing member is caused by the liquid developing agent layer on the developing agent bearing member touching the image bearing member and disturbance of the liquid developing agent layer can be prevented. In this way, this invention can provide an electrostatic latent image liquid developing method that more effectively prevents image inaccuracies.

If a foam-type material is used inside the developing agent bearing member, this invention provides an electrostatic latent image liquid developing method wherein a developing agent bearing member that has the desired hardness value can be obtained comparatively easily.

In addition, if a pre-wetting process is provided, whereby a chemically inactive dielectric liquid that has good release properties is applied as a pre-wet liquid before the developing process starts, the use of an elastic material for the developing agent bearing member in this invention allows a two-layer structure to be maintained in the developing area for the liquid developing agent layer on the developing agent bearing member and the pre-wet liquid layer on the image bearing member when the two layers touch. As a result, the liquid developing agent layer touches the surface of the image bearing member through the medium of the pre-wet liquid layer. Therefore, this invention can provide an electrostatic latent image liquid developing method that more effectively prevents adhesion of toner to the non-image parts on the image bearing member and the occurrence of image inaccuracies.

We claim:

1. A method of electrostatic latent image liquid developing whereby a highly viscous liquid developing agent consisting of charged developing particles in a non-conductive liquid at a high concentration is used to develop electrostatic latent images formed on an image bearing member, said method comprising the steps of:

forming a thin layer of the highly viscous liquid developing agent on an elastic cylindrical developing agent bearing member, an inside of said developing agent bearing member being a foam-type material, rotating the developing agent bearing member in the driven direction in relation to said image bearing member and, at the same time, bringing the liquid developing agent layer on said developing agent bearing member into contact with said image bearing member, thereby supplying said liquid developing agent to the surface of the latent image on said image bearing member, wherein rollers with an external diameter slightly smaller than an external diameter of said developing agent bearing member are provided at both ends of and co-axial with said developing agent bearing member such that said rollers contact said image bearing member and thereby regulate a contact force of said developing agent bearing member against said image bearing member.

2. The electrostatic latent image liquid developing method of claim 1 wherein said developing agent bearing member has a hardness value from 5 to 60 degrees JIS-A.

3. The electrostatic latent image liquid developing method of claim 1, wherein the surface, at least, of said developing agent bearing member is formed from a conductive material that does not absorb said liquid developing agent.

4. The electrostatic latent image liquid developing method of claim 1, wherein a pre-wetting process is provided before said contact process in order to apply a pre-wet liquid, which is a chemically inactive dielectric liquid that has good release properties, to said image bearing member.

5. The electrostatic latent image liquid developing method of claim 4 wherein said pre-wet liquid has a viscosity from 0.5 to 5 mPa.s, an electric resistance of $10^{12}$ Ω cm or more, a boiling point from 100 to 250° C., and a surface tension of 21 dyne/cm or less.

6. The electrostatic latent image liquid developing method of claim 5 wherein silicone fluid is the main component of said pre-wet liquid.

7. The electrostatic latent image liquid developing method of claim 1, wherein a liquid with a viscosity from 100 to 10,000 mPa.s is used for said highly viscous liquid developing agent layer, and wherein the thickness of said highly viscous liquid developing agent on said developing agent bearing member is regulated to be from 5 to 40 μm.

8. The electrostatic latent image liquid developing method of claim 7 wherein said liquid particles with an average particle diameter of 0.1 to 5 μm at concentrations of 5 to 40%.

9. The electrostatic latent image liquid developing method of claim 7 wherein the non-conductive liquid of said liquid developing agent has an electric resistance of $10^{12}$ Ω cm or more, a surface tension of 21 dyne/cm or less, and a boiling point of 100° C. or more.

10. The electrostatic latent image liquid developing method of claim 9 wherein silicone fluid is used as the non-conductive liquid in said liquid developing agent.

11. An electrostatic latent image liquid developing apparatus, comprising:

an image bearing member, an elastic cylindrical developing agent bearing member, the developing agent bearing member being rotatable in a driven direction relative to the image bearing member, an inside of said developing agent bearing member being a foam-type material, a thin layer of highly viscous liquid developing agent being formed on the elastic cylindrical developing agent bearing member, and rollers with an external diameter slightly smaller than an external diameter of said developing agent bearing member arranged at both ends of and co-axial with the developing agent bearing member such that the rollers contact the image bearing member and thereby regulate a contact force of said developing agent bearing member against the image bearing member, wherein the developing agent including charged developing particles is used to develop electrostatic latent images formed on the image bearing member by bringing the thin layer of liquid developing agent on said developing agent bearing member into contact with said image bearing member, thereby supplying said liquid developing agent to the surface of the latent image on said image bearing member.

12. The electrostatic latent image liquid developing apparatus of claim 11 wherein said developing agent bearing member has a hardness value from 5 to 60 degrees JIS-A.

13. The electrostatic latent image liquid developing apparatus of claim 11 wherein the surface, at least, of said developing agent bearing member is formed from a conductive material that does not absorb said liquid developing agent.

14. The electrostatic latent image liquid developing apparatus of claim 11 wherein a pre-wetting means is provided in order to apply a pre-wet liquid, which is a chemically inactive dielectric liquid that has good release properties, to said image bearing member.

15. A method of developing an electrostatic latent image on an image bearing roller, said method comprising the steps of:

providing an elastic developing roller having pressure-limiting rollers at axial ends thereof, said pressure-limiting rollers having an external diameter smaller than an external diameter of the elastic developing roller, an inside of said elastic developing roller being a foam-type material;

arranging said elastic developing roller with said pressure-limiting rollers in contact with said image bearing roller such that said pressure-limiting rollers regulate a contact force between the elastic developing roller and the image bearing roller;

supplying a highly viscous liquid developing agent to the elastic developing roller; and rotating the elastic developing roller along with the image bearing roller such that a thin layer of the developing agent is formed on the elastic developing roller and is applied to the latent image on the image bearing roller.

16. The method of claim 15, wherein said elastic developing roller has a hardness value in the range of 5 to 60 degrees JIS-A.

17. The method of claim 15, wherein at least a surface of said elastic developing roller is formed from a conductive material that does not absorb said liquid developing agent.

18. The method of claim 15, further comprising the step of forming a layer of a pre-wet liquid on said image bearing roller prior to application of said thin layer of the developing agent.

19. The method of claim 15, wherein said liquid developing agent has a viscosity in the range of 100 to 10,000 mPa.s, and wherein said thin layer has a thickness in the range of 5 to 40 μm.

20. An electrostatic latent image developing apparatus, comprising:

an image bearing roller having an electrostatic latent image thereon;

an elastic developing roller having pressure-limiting rollers at axial ends thereof, said pressure-limiting rollers having an external diameter smaller than an external diameter of the elastic developing roller, an inside of said elastic developing roller being a foam-type material, said elastic developing roller being arranged with said pressure-limiting rollers in contact with said image bearing roller such that said pressure-limiting rollers regulate a contact force between the elastic developing roller and the image bearing roller;

a highly viscous liquid developing agent being supplied to the elastic developing roller, the elastic developing roller being rotatable along with the image bearing roller such that a thin layer of the developing agent is formed on the elastic developing roller and is applied to the latent image on the image bearing roller.

21. The apparatus of claim 20, wherein said elastic developing roller has a hardness value in the range of 5 to 60 degrees JIS-A.

22. The apparatus of claim 20, wherein at least a surface of said elastic developing roller is formed from a conductive material that does not absorb said liquid developing agent.

23. The apparatus of claim 20, further comprising a pre-wetting apparatus arranged to form a layer of a pre-wet liquid on said image bearing roller prior to application of said thin layer of the developing agent.

24. The apparatus of claim 20, wherein said liquid developing agent has a viscosity in the range of 100 to 10,000 mPa.s, and wherein said thin layer has a thickness in the range of 5 to 40 $\mu$m.

25. A method of developing an electrostatic latent image on an image bearing roller, said method comprising the steps of:

providing an elastic developing roller, at least a surface of said elastic developing roller being formed from a non-absorbent conductive material, an inside of said elastic developing roller being a foam-type material;

arranging said elastic developing roller and said image bearing roller adjacent each other such that a contact force develops between the elastic developing roller and the image bearing roller;

supplying a highly viscous liquid developing agent to the elastic developing roller; and rotating the elastic developing roller along with the image bearing roller such that a thin layer of the developing agent is formed on the elastic developing roller and is applied to the latent image on the image bearing roller, said developing agent not being absorbed by said elastic developing roller.

26. A method according to claim 25, further comprising the step of regulating the contact force between the elastic developing roller and the image bearing roller.

27. An electrostatic latent image developing apparatus, comprising:

an image bearing roller having an electrostatic latent image thereon;

an elastic developing roller arranged adjacent said image bearing roller such that a contact force develops between the elastic developing roller and the image bearing roller, at least a surface of said elastic developing roller being formed from a non-absorbent conductive material, an inside of said elastic developing roller being a foam-type material;

a highly viscous liquid developing agent being supplied to the elastic developing roller, the elastic developing roller being rotatable along with the image bearing roller such that a thin layer of the developing agent is formed on the elastic developing roller and is applied to the latent image on the image bearing roller, said developing agent not being absorbed by said elastic developing roller.

28. An apparatus according to claim 27, further comprising means for regulating said contact force between the elastic developing roller and the image bearing roller.

29. A method of developing an electrostatic latent image on an image bearing roller via an elastic developing roller, said method comprising the steps of:

arranging said elastic developing roller and said image bearing roller adjacent each other such that a contact force develops between the elastic developing roller and the image bearing roller;

forming a layer of a pre-wet liquid on said image bearing roller;

supplying a highly viscous liquid developing agent consisting of charged developing particles in a non-conductive liquid to the elastic developing roller; and rotating the elastic developing roller along with the image bearing roller such that a thin layer of the developing agent is formed on the elastic developing roller, said thin layer coming into contact with said layer of said pre-wet liquid on said image bearing roller, said charged developing particles migrating through said pre-wet liquid to contact said image bearing roller at said latent image.

30. A method according to claim 29, further comprising the step of regulating said contact force between the elastic developing roller and the image bearing roller.

31. A method according to claim 29, wherein an inside of said elastic developing roller is a foam-type material.

32. A method according to claim 31, wherein at least a surface of said elastic developing roller is formed from a non-absorbent conductive material.

33. An electrostatic latent image developing apparatus, comprising:

an image bearing roller having an electrostatic latent image thereon;

an elastic developing roller arranged adjacent said image bearing roller such that a contact force develops between the elastic developing roller and the image bearing roller;

a pre-wetting apparatus arranged to form a layer of a pre-wet liquid on said image bearing roller a highly viscous liquid developing agent consisting of charged developing particles in a non-conductive liquid being supplied to the elastic developing roller, the elastic developing roller being rotatable along with the image bearing roller such that a thin layer of the developing agent is formed on the elastic developing roller, said thin layer coming into contact with said layer of said pre-wet liquid on said image bearing roller, said charged developing particles migrating through said pre-wet liquid to contact said image bearing roller at said latent image.

34. An apparatus according to claim 33, further comprising means for regulating said contact force between the elastic developing roller and the image bearing roller.

35. An apparatus according to claim 33, wherein an inside of said elastic developing roller is a foam-type material.

36. An apparatus according to claim 35, wherein at least a surface of said elastic developing roller is formed from a non-absorbent conductive material.

* * * * *